US005997122A

United States Patent [19]

Moriyama et al.

[11] Patent Number: 5,997,122

[45] Date of Patent: Dec. 7, 1999

[54] INK JET RECORDING APPARATUS CAPABLE OF PERFORMING LIQUID DROPLET DIAMETER RANDOM VARIABLE RECORDING AND INK JET RECORDING METHOD USING INK FOR LIQUID DROPLET RANDOM VARIABLE RECORDING

[75] Inventors: Jiro Moriyama; Yutaka Koizumi; Shoji Koike; Yoshinobu Shimomura, all of Yokohama; Toshiaki Hirosawa, Hiratsuka; Torachika Osada; Kyoko Fukushima, both of Yokohama, all of Japan

[73] Assignee: Canon Kabushiki Kaisha, Tokyo, Japan

[21] Appl. No.: 08/745,873

[22] Filed: Nov. 8, 1996

Related U.S. Application Data

[63] Continuation of application No. 08/083,433, Jun. 29, 1993, abandoned.

[30] Foreign Application Priority Data

Jun. 30, 1992 [JP] Japan ..... 4-173334
Jul. 16, 1992 [JP] Japan ..... 4-189401

[51] Int. Cl.[6] ..... B41J 29/38

[52] U.S. Cl. ..... 347/11

[58] Field of Search ..... 347/10, 11, 15, 347/60, 100

[56] References Cited

U.S. PATENT DOCUMENTS

| | | | |
|---|---|---|---|
| 4,251,824 | 2/1981 | Hara et al. . | |
| 4,313,124 | 1/1982 | Hara . | |
| 4,335,184 | 6/1982 | Miyamoto et al. | 347/105 X |
| 4,345,262 | 8/1982 | Shirato et al. . | |
| 4,394,662 | 7/1983 | Yoshida et al. | 347/15 X |
| 4,459,600 | 7/1984 | Sato et al. . | |
| 4,463,359 | 7/1984 | Ayata et al. . | |
| 4,510,507 | 4/1985 | Ishikawa . | |
| 4,558,333 | 12/1985 | Sugitani et al. . | |
| 4,631,548 | 12/1986 | Milbrandt | 347/43 X |
| 4,639,735 | 1/1987 | Yamamoto et al. . | |
| 4,723,129 | 2/1988 | Endo et al. . | |
| 4,740,796 | 4/1988 | Endo et al. . | |
| 4,832,518 | 5/1989 | Moriyama . | |
| 4,969,951 | 11/1990 | Koike et al. | 347/100 X |
| 4,985,779 | 1/1991 | Gall | 358/298 |
| 5,083,210 | 1/1992 | Reilly et al. | 347/3 X |
| 5,173,717 | 12/1992 | Kishida et al. . | |

FOREIGN PATENT DOCUMENTS

| | | | |
|---|---|---|---|
| 0373894 | 6/1990 | European Pat. Off. | 347/60 |
| 59-176055 | 10/1984 | Japan | 347/15 |
| 3-221459 | 9/1991 | Japan | B41J 2/045 |

*Primary Examiner*—N. Le
*Assistant Examiner*—Judy Nguyen
*Attorney, Agent, or Firm*—Fitzpatrick, Cella, Harper & Scinto

[57] ABSTRACT

In a recording apparatus provided with a plurality of discharging ports for discharging ink, and discharging elements for discharging ink upon application of electrical pulses, the volume of ink droplets discharged from each of the discharging ports is caused to vary due to the properties of each discharging port. This variation results in a conspicuous unevenness in recording. The present invention provides a method for making such recording unevenness due to the properties of each discharging port inconspicuous by varying the volume of ink droplets discharged from each of the plural discharging ports at random. Also, the present invention provides a technique in which the volume of discharging ink droplets is varied at random by use of a specific ink in order to make the recording unevenness inconspicuous.

53 Claims, 11 Drawing Sheets

INK JET RECORDING APPARATUS CAPABLE OF PERFORMING LIQUID DROPLET DIAMETER RANDOM VARIABLE RECORDING AND INK JET RECORDING METHOD USING INK FOR LIQUID DROPLET RANDOM VARIABLE RECORDING

This application is a continuation of application Ser. No. 08/083,433 filed Jun. 29, 1993, now abandoned.

BACKGROUND OF THE INVENTION

1. Field of the Invention

The present invention relates to a liquid droplet diameter random variable recording method for an on-demand type ink jet recording head for recording characters and images by discharging ink droplets instantaneously as required. Particularly, the invention relates to a liquid droplet diameter random variable recording method wherein a TJ (thermal jet) recording head having a plurality of heat generating elements on a recording head substrate and nozzles corresponding to these heat generating elements is provided to record by use of a specific ink and transfer sheet and also by varying the volume of ink droplets discharged from each of the nozzles at random with time. The invention also relates to an apparatus using such a method and ink composition which enables the liquid droplet diameter to be varied at random.

2. Related Background Art

FIG. 2 is a view schematically showing the structure of an example of an ink jet recording head of a recording apparatus of the kind according to the prior art. A recording head 21 has a plurality of nozzles (discharging ports) 2 and heat generating elements 3 corresponding to each of the nozzles 2. The total number of the nozzles of the recording head 21 shown in FIG. 2 are 2,048 which are arranged in the direction perpendicular to a surface of a sheet. The heat generating elements 3 transduce a part of applied electrical energy into ink discharging energy. The recording of characters and images is performed as given below. Each of the heat generating elements 3 is selectively driven by a head driving circuit 4 as required for generating heat. Due to this heat generation, bubbles are generated in a pressuring chamber 9. With the development of the bubbles, the ink droplets 5 are forwardly ejected (discharged) from the nozzles 2. The discharged ink droplets fly and are shot onto the surface of a recording sheet which is a recording medium 11 to form desired characters or images. In this respect, a reference numeral 7 designates a head; 8, a protective film to protect the heat generating elements 3; 17, lead lines; and 20, ink in an ink supply tube 19.

The volume Vd of ink droplets discharged from each of the nozzles of an ink jet head having a plurality of ink discharging nozzles has not been completely even, and an average volume Vdm of the ink droplets from each of the nozzles has hitherto been different per nozzle. Also, the volume of the ink droplets discharged from a specific nozzle fluctuates within a regular minute range.

Here, FIG. 3 is a conceptual view showing the "frequency" against "the area of shot ink" when the shot ink on a recording medium has colored the recording medium using a conventional recording head, ink, and transfer sheet. For explanation, FIG. 3 illustrates a case where three nozzles are employed, for example, and the mean value of the shot areas of the ink discharged from each of the nozzles is A for relatively small, B for medium, and C for relatively large. In practice, if the shot ink on the recording medium is continuous, it is difficult to measure the area per droplet exactly. However, with a particular attention given to the fact that the volume of the discharged ink droplet and the shot area has a close correlation, the volume Vd of the ink droplet is measured with the following result.

FIGS. 4A, 4B, and 4C show the data on the measurement of the frequency (%) of the volume Vd of the ink droplets with attention given to the three nozzles a, b, and c of the 2,048 nozzles of a recording head, respectively. The nozzle a represents the characteristics of the 253rd bit; b, 254th bit; and c, 255th bit. In this case, the mean volume Vdm of the ink droplet of the nozzle and standard deviation Vdσ corresponding to each bit are as shown in the following table; where the unit is pl (picoliter) and figures shown in ( ) are the numerical value of %:

TABLE 1

| | (a) | (b) | (c) |
|---|---|---|---|
| bit | 253 | 254 | 255 |
| Vdm (pl) | 162 | 166 | 186 |
| Vdσ (pl (%)) | 7 (4.3) | 8 (4.8) | 9 (4.8) |

As described above, it is extremely difficult in practice to equalize the mean values Vdm of the volume of the ink droplets discharged from a plurality of nozzles of the kind because the volume Vd of the discharged ink droplets 5 is caused by the configuration and structure of the nozzles 2 and minute dimensional errors brought about by its fabrication to deviate from a target value considerably. For example, there are variations without exception in the width, height, cross-sectional area of the nozzles 2, the configuration of nozzle ends, the distance from the nozzle ends to the heat generating elements 3, and the calorific values and others generated by each of the heat generating elements 3 even when the same electrical energy is equally provided for each of them. Therefore, these variations affect the volume Vd of the ink droplets 5 discharged from each of the nozzles 2.

These variations cause the generation of unevenness in recording in the same direction as the one in which the recording head 21 and recording sheet 11 are shifted correlatively (indicated by an arrow) when a recording is executed as the specimen of a recorded image shown in FIG. 5, for example. FIG. 5 represents the result of a recording using the 251st to 257th bits. The recorded dot diameter of the 253rd bit is slightly smaller while that of the 255th bit is slightly larger in this recording. This recording unevenness is not easily noticeable in a pattern such as characters or the like for which the recording frequency of each of the nozzles 2 (printing ratio) is low. However, when the same pattern is continuously recorded so that the printing ratio is heightened, this kind of unevenness tends to occur. As far as these recording unevennesses remain invisible, there will be no problem. In reality, however, if there is a variation in the areas of a recording point adjacent to each other, which are colored by the ink discharged on a recording medium 11, the recording unevenness becomes visible, leading to the degradation of recording finish (quality).

Particularly, when a recording head 21 of the kind is mass produced, these unevennesses result in reducing the throughful of the recording heads 21 satisfactorily usable for an actual recording so that a cost therefor rises.

As a counter measure, there is a method wherein a means is provided to adjust the electrical energy given to the heat generating elements 3 of each nozzle 2 at the time of discharge in order to prevent a recording unevenness of the kind from being generated. More specifically, the voltage value and/or the pulse width of electrical energy to be applied to the heat generating elements 3 of each nozzle 2 is adjusted so that the volume Vd of the ink droplets 5 can be equalized when discharged. However, unless the number of the nozzles 2 is several, this regulating adjustment method requires a complicated circuit, and particularly when the number of nozzles increases up to such as 24, 48, 64, . . . , . . . , 2,408, or still more, it is desirable to adopt some simpler method.

On the other hand, there is known a method wherein before an electrical signal for the ink discharging induction, some other signal is applied to controlling the magnitude of energy given to the heat generating elements 3 in order to adjust the volume Vd of the ink droplets 5 or to perform a gradient recording, but a method wherein the ink discharging volume Vd from a specific nozzle is intentionally varied at random is not known at all.

Now, FIGS. 6A, 6B, and 6C show the data on the measurements of frequency (%) of the volume Vd of ink droplets with attention given to three nozzles d, e, and f of 2,048 nozzles of another recording head. Here, the reference mark d designates the nozzle characteristics of the 253rd bit; e, 254th bit; and f, 255th bit. In the following table 2, the mean volume Vdm and the standard deviation Vdσ are shown in the same manner as the data shown in the table 1:

TABLE 2

| nozzle | d | e | f |
|---|---|---|---|
| bit | 253 | 254 | 255 |
| Vdm pl | 147 | 166 | 184 |
| Vdσ pl (%) | 5 (3.4) | 4 (2.4) | 4 (2.2) |

In this respect, the measurement data shown in FIG. 4 are the values when the recording head is driven at 800 Hz. The composition, surface tension, viscosity of the ink used here (comparison ink 16) are shown in the table 3 given below.

TABLE 3

| | |
|---|---|
| C. I. direct yellow-86 | 2 parts |
| diethylene glycol | 15 parts |
| isopropyl alcohol | 4 parts |
| water | 79 parts |
| surface tension: 49 dyn/cm, viscosity: 1.8 cP | |

Conventionally, as a surface sizing agent of a transfer agent for a transfer sheet used for a copying machine, printer, and the like of an ink jet and thermal jet recording type, and electronic photographing type, an inner sizing agent, gelatin, starch, and the like are used in general; the starch occupies must of its composition.

The ratio of this starch should desirably be 1.0% or more in weight in general for the ink jet and thermal jet recording type. Also, for the electronic photographing type, most of them are approximately 0.1 to 1.5%. It has been necessary to use the above-mentioned transfer materials of the two kinds depending on the optimal properties of the copying machine, printer, and the like of both types. As described earlier, the volume of ink droplets discharged from a plurality of nozzles fluctuates in a certain range, and also, the ink droplets discharged from a specific nozzle fluctuate within a regular range. This is fundamentally due to the fact that ink is discharged by controlling the bubbles in the TJ recording method. It is conceivable that because of the residual amount of the minute air bubbles of the last discharging, the next foaming state is caused to change in a continuous discharging. The residual amount of such minute air bubbles is not constant. It changes each time. Therefore, even the ink droplets from a specific nozzle also fluctuate within a regular range.

Of these conditions, the variation of the mean value Vdm of the volume of the former ink droplets particularly generates the recording unevenness in the same direction as the direction in which the recording head 21 and the sheet 11 are shifted correlatively in operating a recording as shown in FIG. 7. The direction of the correlative shift is indicated by an arrow. FIG. 7 represents the results of recording made by use of the 251st to 257th bits. The recorded dot diameters are: slightly small for the 253rd bit; mean value for the 254th bit; and slightly large for the 255th bit.

This recording unevenness is not easily visible in a pattern such as characters having a low recording frequency (printing ratio) of each nozzle. However, the unevenness tends to be generated when the same pattern is recorded continuously at a higher printing ratio. Although there is no problem as far as the recording unevenness remains invisible, but, in reality, it is visually judged as a recording unevenness if there is a variation in the areas of recording point adjacent to each, which are colored by the ink discharged on a recording medium.

SUMMARY OF THE INVENTION

The present invention is designed to solve the above-mentioned problems. It is an object of the invention to provide means for making inconspicuous as a whole the recording unevenness due to the varied volume of ink droplets discharged from a specific nozzle by changing the volume of the discharging ink droplets totally by varying the discharging amount of the ink droplets discharged from a specific nozzle at random within a standard deviation of a certain width without fixing it at a given value in a recording apparatus using an ink jet recording head which discharges ink from a plurality of nozzles.

In order to achieve the foregoing object, an ink jet recording apparatus of the kind according to the present invention is provided with a recording head having a plurality of ink discharging ports and energy transducing means for transducing an electrical energy to an ink discharging energy corresponding to each of the plural discharging ports, and is structured to enable the volume of the ink droplets discharged from each of the foregoing plural discharging ports to be minutely varied at random for recording; or is structured so that the foregoing energy transducing means serve as heat generating elements, and the foregoing electrical energy which induces these heat generating elements to discharge ink is varied at random; or is structured so that there are provided a first electrical energy which induces the heat generating elements to discharge ink, and a second electrical energy having a smaller magnitude than the first electrical energy, which is given prior thereto, and this second electrical energy is varied at random; or is structured so that both the first and second electrical energies are of those having rectangular waveforms, and the pulse width T2 which provides the second electrical energy is varied at random; or is structured so that the foregoing first and second electrical energies are those having rectangular waveforms, and an interval T3 between the respective times in giving the first and second electrical energies is varied at random; or is structured so that the forgoing first and second electrical energies are those having rectangular waveforms, and the value of a voltage V2 given to the second electrical energy is varied at random; or is structured so that the volume of the ink droplets discharged from each of the foregoing plural discharging ports is varied at random per discharge; or is structured so that only the forgoing second electrical energy is applied when the recording is at rest; or is structured so that the foregoing energy transducing means are piezoelectric elements, and the foregoing electrical energy which causes these piezoelectric elements to induce the ink discharging is varied at random.

With the structures of the present invention described above, the volume of the ink droplets discharged from a specific nozzle is not fixed at a given value, and can be varied at random with a certain standard deviation. As a result, unlike the prior art, the recording unevenness due to the variation of the volume of the ink droplets discharged from a specific nozzle becomes inconspicuous as a whole. Thus, the recording quality can be improved.

In this respect, the present invention is different from the method which has already been disclosed as diffusing the recording points as a whole by processing the digital gradient recording data, that is, the so-called error diffusion method. In recording by the application of the error diffusion method, the volume of the ink droplets discharged from one and the same nozzle is always constant contrary to the present invention.

Also, the present invention uses an ink of a specific composition in order to vary the respective amounts of ink droplets discharged from a plurality of nozzles at random with a certain width a so that these amounts are not stabilized at a given value, thus varying the volume Vd of the discharging ink droplets as a whole and enabling the recording unevenness due to the characteristics of the volume of ink droplets discharged from a specific nozzle to be made inconspicuous.

Also, as the transfer sheet for ink jet and thermal jet recording, the more the surface sizing agent is loaded, the smaller becomes the image defect due to ink bleeding, or the like. On the other hand, as the transfer sheet for electronic photographing, it is conceivable that the photosensitive element, fixation roller, and others are stained at high temperatures or under a highly humid environment if the load ratio of the surface sizing agent exceed the above-mentioned range.

It is an object of the present invention to provide a transfer sheet which can be shared for use by the above-mentioned ink jet and thermal jet recording and the electronic photographing. Therefore, as a result of studying on the limits of both characteristics, the optimal range of the load ratio, particularly the amount of starch to be applied, has been found, thus contributing to the achievement of the present invention.

The oxidized starch which is mainly used as the surface sizing agent for the above-mentioned transfer sheet is a free-flowing crystalline substance having a high flowability under normal environment, but has a deliquescence and is agglomerated if it is left intact under a high humid environment of around 80% humidity, for example.

DETAILED DESCRIPTION OF THE PREFERRED EMBODIMENTS

Embodiments

Hereinafter, in conjunction with the accompanying drawings, the description will be made of the embodiments according to the present invention. In this respect, unless otherwise designated in the description, the part and percentage (%) are represented to mean the respective weight standards.

First Embodiment

Figure 1:
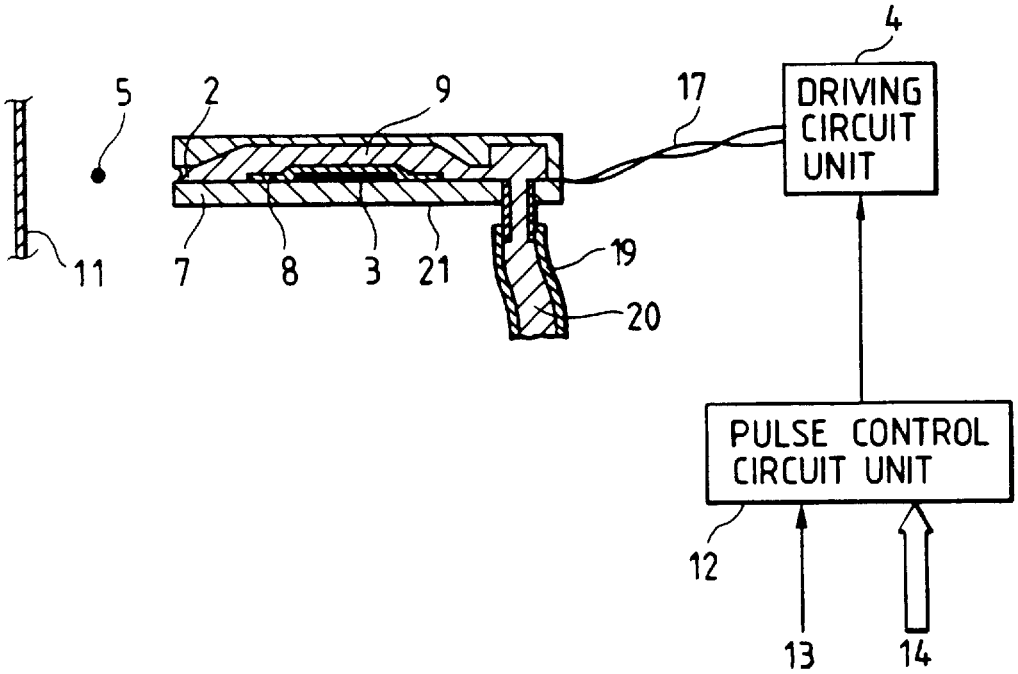
FIG. 1 is a view schematically showing the structure of a recording head and the driving unit of the head according to the present invention.
Figure 2:
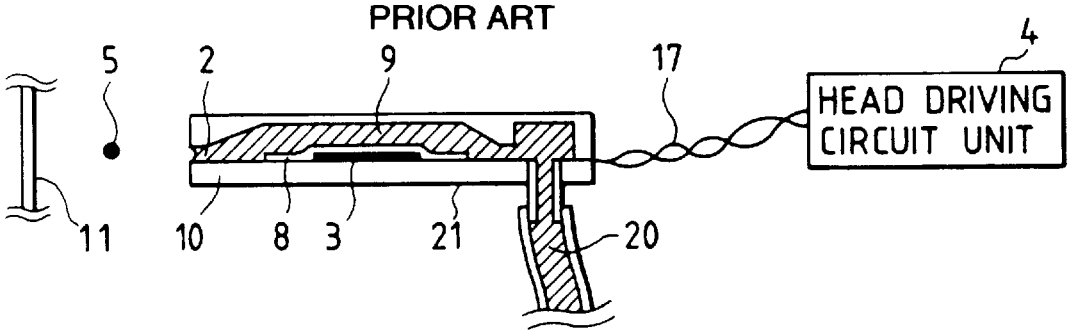
FIG. 2 PRIOR ART
FIG. 2 is a view schematically showing the structure of an example of an ink jet recording head according to the prior art.

There is shown in FIG. 1, the cross-sectional view illustrating a recording head and the schematic structure of a head driving unit according to the first embodiment of an ink jet recording apparatus of the present invention, which are equivalent to those shown in FIG. 2, in which the same (equivalent) constituents are designated by the same reference marks. The recording head 21 is the same as the one according to the prior art. The recording head 21 shown in FIG. 1 is provided with 2,048 nozzles (discharging ports) 2 in total in the direction perpendicular to the surface of FIG. 1 in a density of 8 nozzles per mm. The recording head 21 and a recording medium 11 can be shifted correlatively to record with a record printing width of 256 mm.

Each of the nozzles 2 is provided with heat generating elements 3 correspondingly. Electrical pulses are selectively applied by a head driving circuit 4 to the heat generating elements 3 to generate heat, thus causing ink droplets 5 to be ejected (discharged) toward a recording sheet which is a recording medium 11. The heat generating elements 3 are arranged on an insulator or semiconductor substrate 7 made of glass or silicon which is comparatively inexpensive, yet has a high flatness (the one exemplified in FIG. 1 is made of glass). A protective film 8 of $SiO_2$ is provided so that the elements are not in contact with ink 20 directly. The electrical energy to cause the heat generating elements 3 to generate heat is transmitted to the heat generating elements 3 from the head driving circuit 4 through lead lines 17 and wiring formed flatly on the substrate 7. In this respect, a reference numeral 12 designates a pulse control circuit; 13, record timing signals; and 14, recording data in FIG. 1.

Here, the composition of ink used for the present embodiment is as follows:

| | % |
|---|---|
| C. E. hood black | 3 |
| diethylene glycol | 15 |
| isopropyl alcohol | 4 |
| water | 78 |

Figure 8:
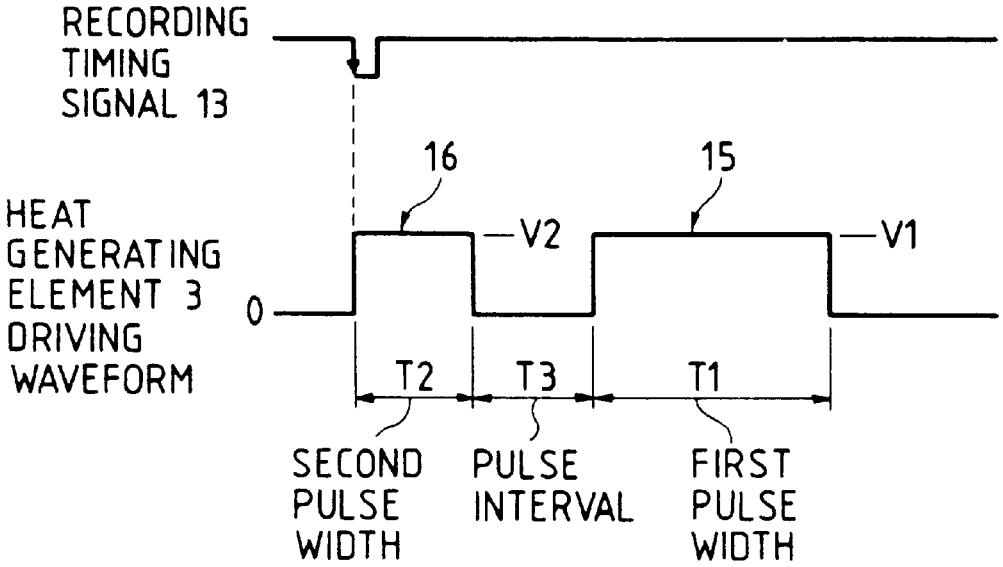
FIG. 8 is a view showing an example of a timing chart for the driving waveform of the heat generating elements according to a first embodiment.

FIG. 8 shows an example of a timing chart for explaining the driving waveform of the electrical energy which enables the heat generating elements 3 of the head 21 of the present embodiment to generate heat. A first driving waveform 15 which gives energy to the heat generating elements 3 to generate heat for discharging ink 20 is in a state of pulse (rectangular waves), and its voltage value V1 is constant having a pulse width T1=6 μsec. Ahead of the first driving waveform 15, a second driving waveform 16 is provided at a voltage V2 (=V1) which is equal to the first waveform 15 in the pulse width T2 (<T1) 16 which is shorter than that of the first driving waveform 15. The interval T3 between the first driving waveform 15 and the second driving waveform 16 is a constant value in the present embodiment.

Here, the pulse width T2 is varied at random around T2=4 μsec in accordance with recording data by means of the pulse control circuit 12 shown in FIG. 1 which is a circuit to generate the second driving waveform 16 in the pulse width T2 at random. The range of the variation is ±3 μsec.

Figure 9:
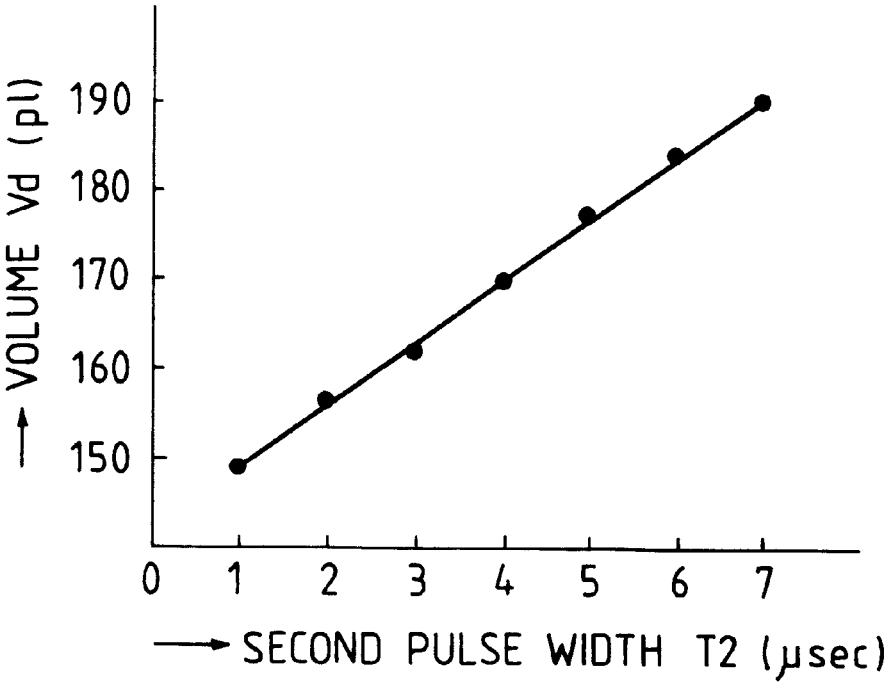
FIG. 9 is a view showing an example of the characteristics of the mean value of the volume of ink droplets with respect to a second driving pulse width according to the first embodiment.

FIG. 9 shows an example of the characteristics of the mean value of the volume Vd of the ink droplets discharged corresponding to the second pulse width T2. The volume Vd of the discharging ink droplets 5 is 170 ±20 pl.

Figure 5:
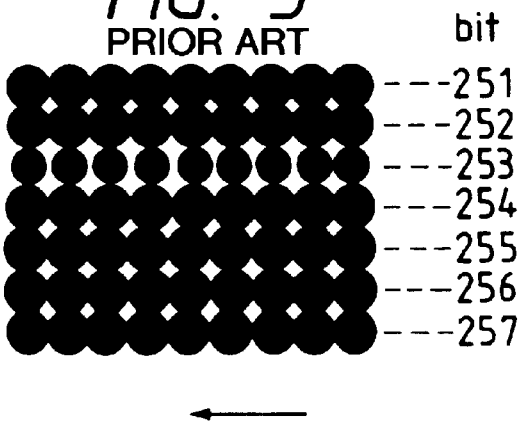
FIG. 5 PRIOR ART
FIG. 5 is a view showing an example of a recorded image formed by use of a part of nozzles of a recording head according to the prior art.
Figure 10:
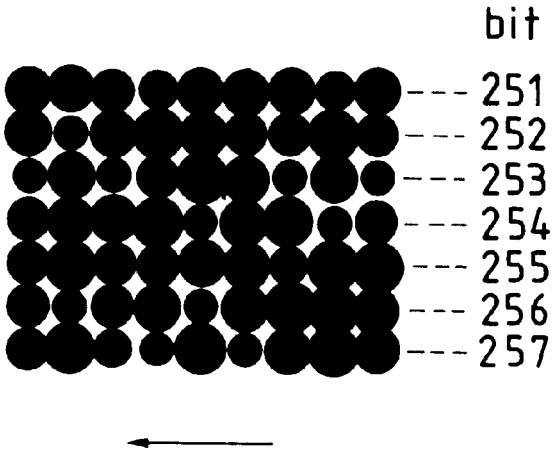
FIG. 10 is a view showing an example of a recorded image by use of each of the nozzles according to the present embodiment.

FIG. 10 shows an example of the recording result of each of the nozzles 2 according to the present embodiment and is a view showing such an example in comparison with the one shown in FIG. 5. According to the prior art, the recording unevenness is conspicuous in the direction of the correlative shift (indicated by an arrow) of the recording medium 11 and the recording head 21 as shown in FIG. 5. Here, however, such unevenness is inconspicuous, that is, the recording quality is improved.

Figure 4A:
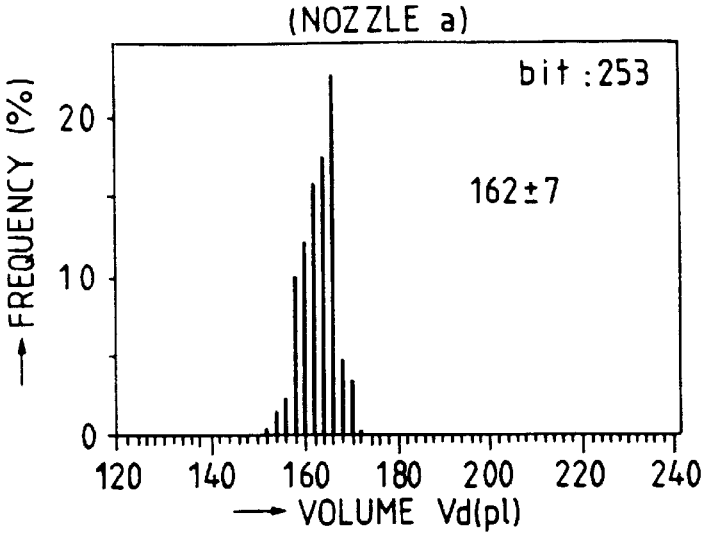
FIG. 4A PRIOR ART
FIGS. 4A to 4C are views showing the frequency distribution characteristics of the volume of ink droplets according to the prior art.
Figure 4B:
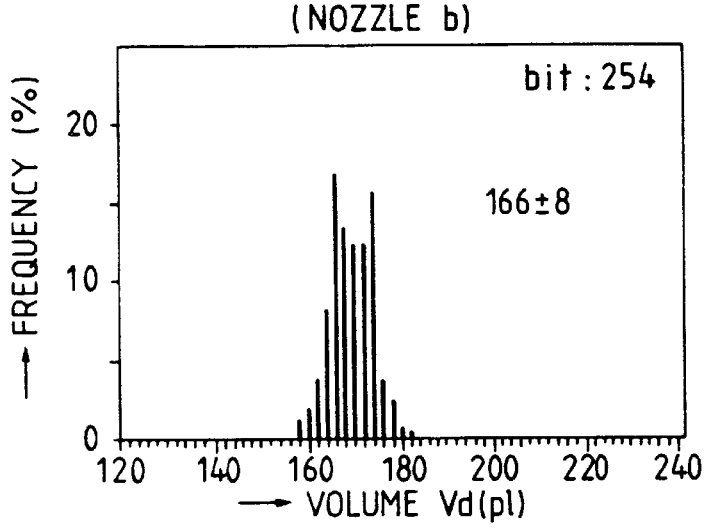
FIG. 4B PRIOR ART
Figure 4C:
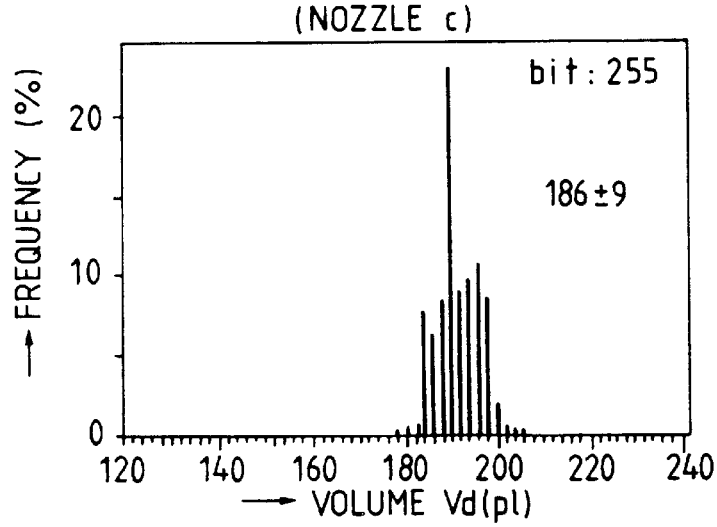
FIG. 4C PRIOR ART
Figure 6A:
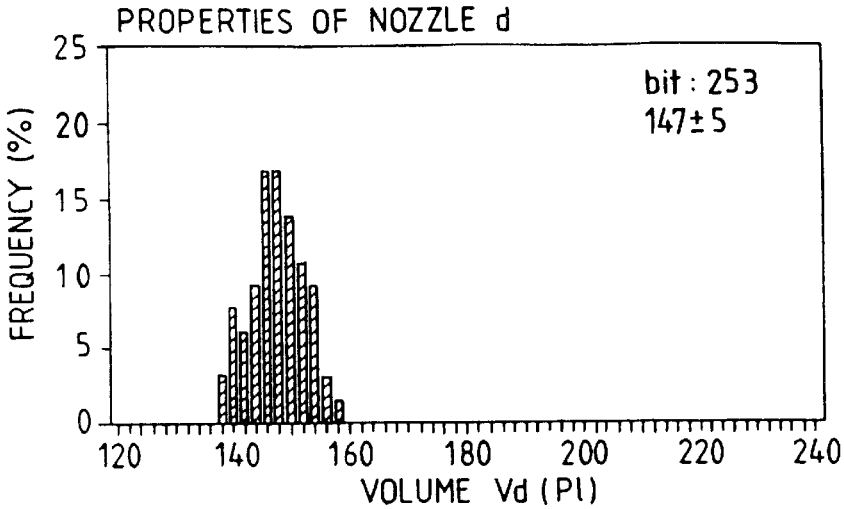
FIG. 6A PRIOR ART
FIGS. 6A to 6C are views showing the frequency distribution of the volume of the ink droplets discharged from each of the nozzles according to the prior art.
Figure 6B:
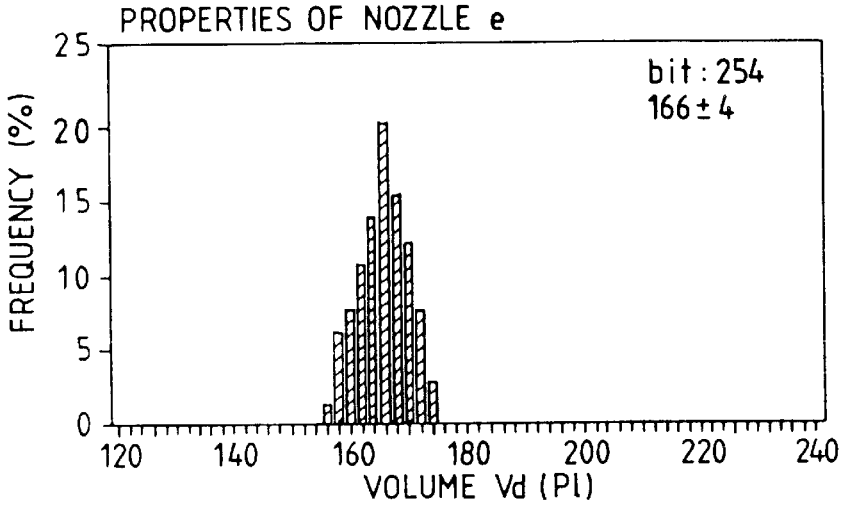
FIG. 6B PRIOR ART
Figure 6C:
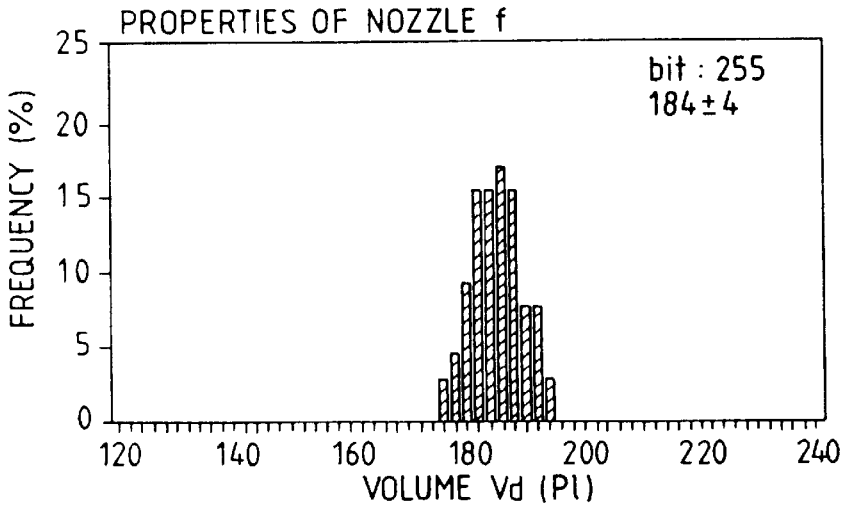
FIG. 6C PRIOR ART
Figure 11:
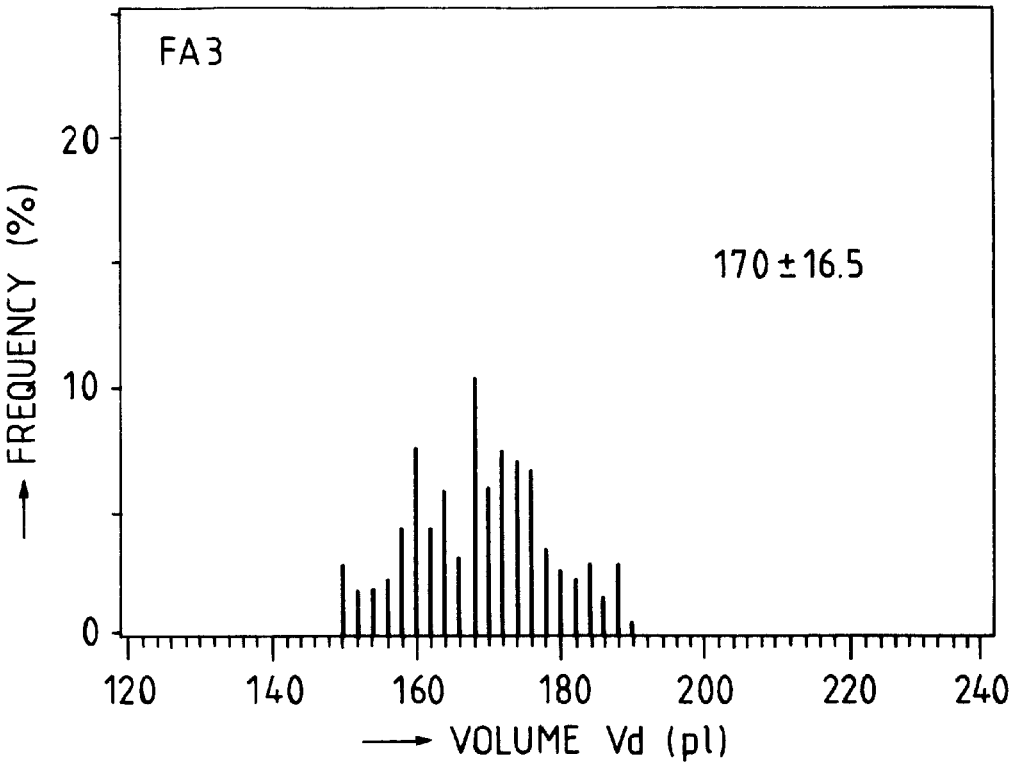
FIG. 11 is a view showing the frequency distribution characteristics of the volume of the ink droplets according to the first embodiment.

In this way, the volume Vd of the discharging ink droplets 5 is varied within a range of approximately ±11.8% by changing the second pulse width T2 at random. In practice, it is varied so that the value of the standard deviation Vdσ is 8% or more. Also, as shown in the Table 1, the volume Vd of the ink droplets 5 discharged from a specific nozzle 2 is varied at 4.3 to 4.8% with the standard deviation Vdσ. Consequently, it changes at approximately 9.3% or more with the standard deviation Vdσ comprehensively. As an example at this juncture, the distribution characteristics of the generation frequency of the volume Vd of the ink droplets 5 is shown in FIG. 11 in comparison with the foregoing FIGS. 4A to 4C.

Figure 3:
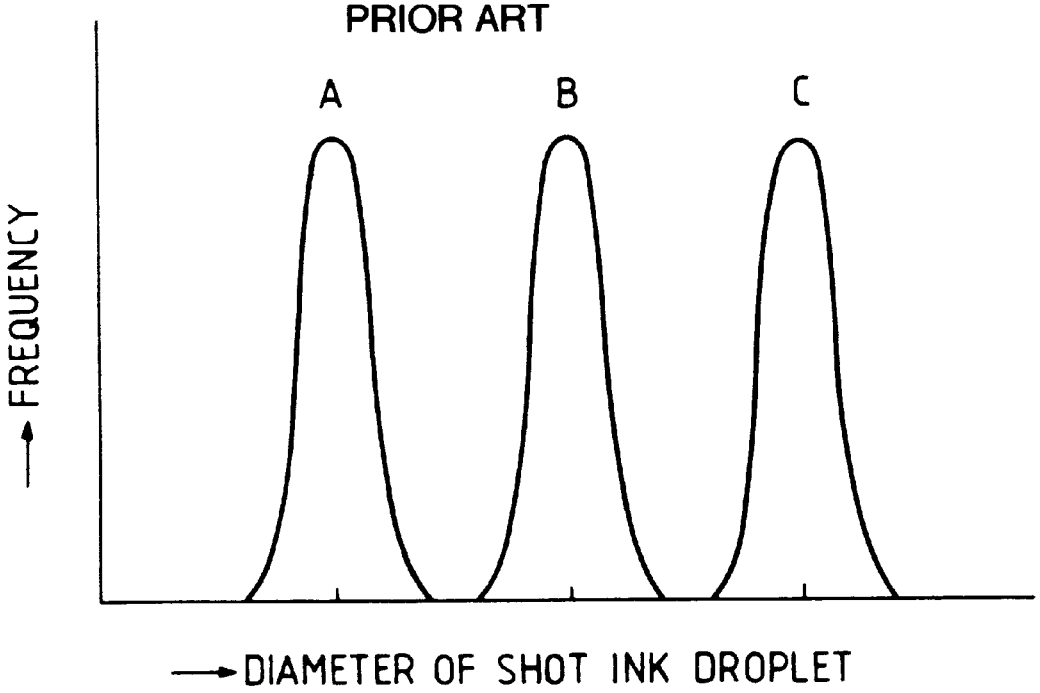
FIG. 3 PRIOR ART
FIG. 3 is a conceptual view showing the generation frequency against the shot ink area according to the prior art.
Figure 12:
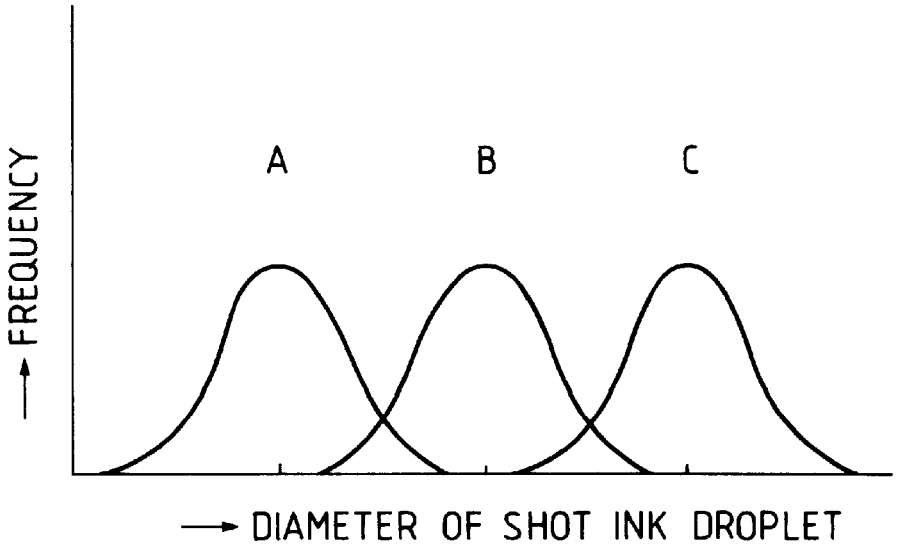
FIG. 12 is a view showing the effects of the present embodiment in contrast to FIG. 3.

FIG. 12 is a conceptual view showing the effect of the present invention in which the generation frequency distribution with respect to the shot ink diameters is illustrated in comparison with FIG. 3.

FIG. 3 exemplifies a result of the recording method according to the prior art. FIG. 12 exemplifies the result brought about by the recording method according to the present embodiment. Compared to the distribution shown in FIG. 3, FIG. 12 shows the one in which the generation of frequency is not concentrated on a specific diameter, but is widely distributed overall. In this respect, although it is difficult to measure the shot diameters of the ink droplets 5 recorded continuously on a recording sheet 11 as shown in FIG. 5 or FIG. 10, it is possible to anticipate them as shown in each of the figures from the volume Vd of the ink droplets 5. Also, as shown in FIG. 12, the wider the spreading of the shot diameters of the each of the nozzles A, B, and C, the more negligible is the dispersion of the mean value of the volume Vd of each nozzle.

As described above, the ink droplets 5 are discharged from each of the nozzles 2 so that the volume Vd of the droplets discharged is distributed in a wide range. According to a microscopic observation with attention given to each of the ink droplets 5, the recorded characters and images appear slightly rough on the surface at a glance and it is sensed as if the recording quality becomes inferior. Actually, however, the recording quality is improved when observed comprehensively. This judgment is more clear by observing the recorded objects from the position slightly away (in a case of the recording density of eight points per mm, a position which is 25 cm or more away from the object, for example).

If any of specific patterns exists with the variation (fluctuation) of the volume Vd of the ink droplets 5 such as this, it should appear as a comprehensive unevenness. Therefore, it is prerequisite that there is no specific pattern with respect to this variation, that is, the variation should be distributed at random. The amount of the variation will be good enough if it is 9.0% in practice. This judgment is obtained after repeating the same experiment with the value of the standard deviation on the amounts of the variation as 8.0%, 8.5%, 9.0% and 9.5% by adjusting the pulse width control circuit 15 accordingly.

As described above, according to the present embodiment, the higher the frequency of the discharge of ink 20 from each of the nozzles 2, the greater is the effect obtainable by the present embodiment because the recorded characters and images are judged by the comprehensive observation by varying the volume Vd of the ink droplets 5. On the contrary, this is not very effective in the area where the discharging frequency is low and the recording is discontinuous with the low number of recording cycles. Therefore, the fundamental effect of the present invention is obtainable by making an arrangement so that a variation of the kind is provided only in the area where the number of recording cycles is high or the amount of the variation is made greater in the area where the number of recording cycles is high.

Here, in the above-mentioned experiment, the measurement of the volume Vd of each discharged ink droplet 5 is made by use of a measuring system comprising a microscope provided with a strobe flash and a CCD camera, and the image of the ink droplet 5 photographed by the CCD camera is image processed for the intended measurement.

In energizing the heat generating elements 3, two driving pulses are used according to the present embodiment. Compared to the case where the pulse width and height of one driving pulse are varied, this has the advantage that the present embodiment provides a greater amount of variation of the volume Vd of the discharging ink with respect to the variation of the pulse width as compared to the latter case when an attention is given to changing the pulse widths. When one pulse is used with changing its width and height, it takes ±5 μsec. Against this, the present embodiment should take only ±3 μsec of 60%. The fact that the variable range can be 60% means an advantage that a recording time can be shortened, that is, it becomes possible to record at a higher speed.

Second Embodiment

As described above, the foregoing first embodiment is such that the variation of the discharging amount of ink (volume of ink droplets) ejected (discharged) from the nozzles (discharging ports) is made by two pulses. Now, a second embodiment will be described, where the variation is made by single pulses. In this respect, the fundamental structure and related art are exactly the same as those used in the first embodiment, and FIG. 1, FIG. 10, FIG. 3, and FIG. 12 are shared, and at the same time, FIG. 13 which corresponds to the foregoing FIG. 9, and FIG. 14, to FIG. 11, are used in describing the second embodiment.

The recording head 21 used for the present embodiment is of the same schematic structure shown in FIG. 1, and the ink composition is also the same. The energy which causes the heat generating elements 3 to generate heat corresponding to each of the nozzles 2 is transmitted from the head driving circuit 4 to the heat generating elements 3 through the pulse control circuit 12, lead lines 17, and wiring formed flatly on the substrate 7. This driving waveform is rectangular, and its voltage value is constant. On the other hand, the width of the driving waveform, that is, the pulse width Pw is varied at random by the pulse width random generating unit in the pulse control circuit 12 around Pw=15 μsec. The width of variation is ±5 μsec.

Figure 13:
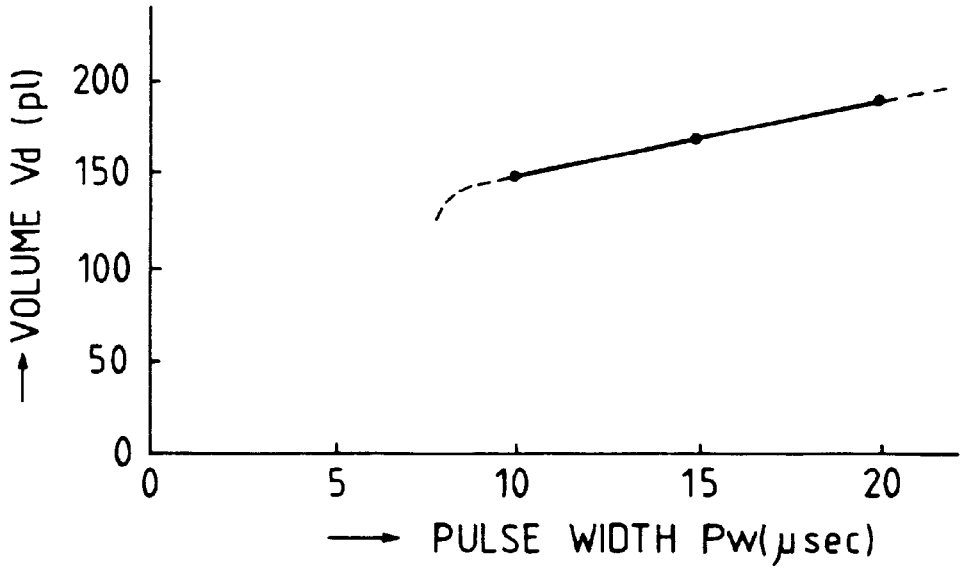
FIG. 13 is a view showing an example of the mean value characteristics of the ink droplets with respect to the pulse width according to the second embodiment.
Figure 14:
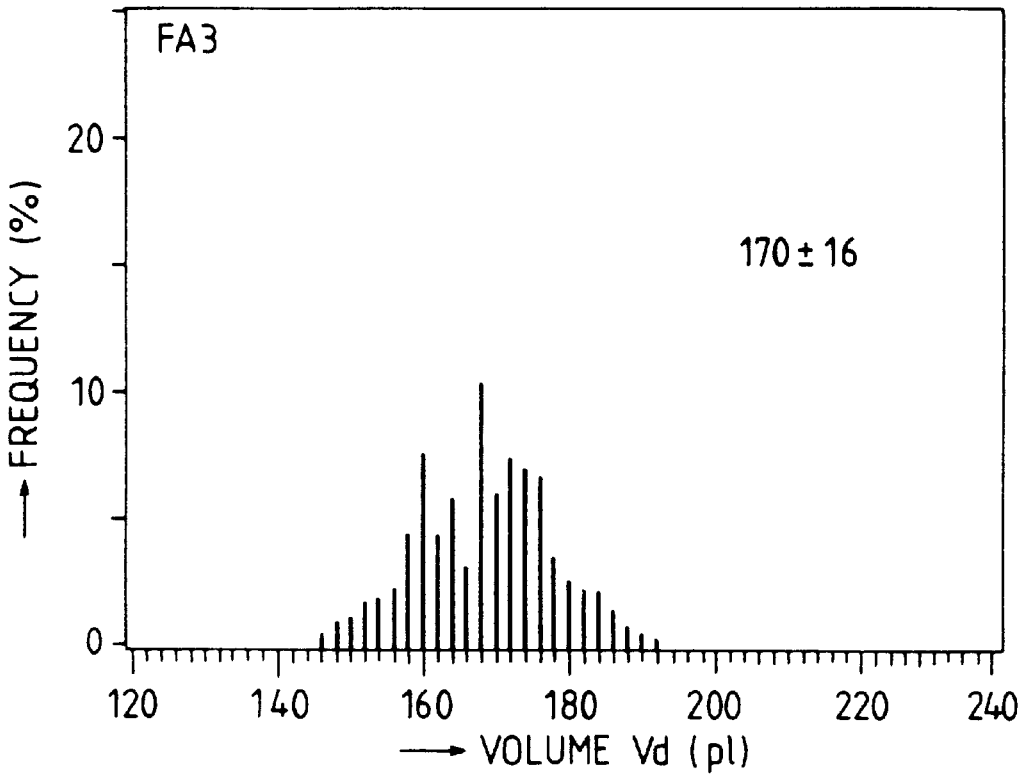
FIG. 14 is a view showing an example of the frequency distribution characteristics of the volume of the ink droplets according to the second embodiment.

FIG. 13 shows an example of the characteristic curvature of the mean value of the volume Vd of the discharged ink droplets 5 with respect to the pulse width Pw of the recording head (corresponding to FIG. 9 in the first embodiment). If the pulse width Pw is too narrow, the ink may not be discharged. Therefore, it is impossible to make it very narrow. Also, if it is too great, the heat generating elements 3 themselves may be burnt. It cannot be made very great. The pulse width Pw should be varied within this range accordingly, and the ink droplet volume Vd at this juncture is 170±20 pl on the average.

FIG. 10 is a view illustrating the recording result of the second embodiment as in the case of the first embodiment. The recording unevenness which is conspicuous as shown in FIG. 11 in the correlative shifting direction of the recording medium (recording sheet) 11 and the recording head 21 according to the prior art is now inconspicuous. In other words, the recording quality is improved.

In this way, the volume Vd of the discharging ink droplets 5 is varied within a range of ±11.8% by changing the pulse width Pw at random. In practice, it is varied so that the value of the standard deviation becomes 8% or more. Also, as shown in the foregoing Table 1, the volume Vd of the ink droplets 5 discharged from a specific nozzle should be varied 4.3 to 4.8% with the standard deviation Vdσ. Therefore, it should be varied approximately 9.3% or more with the standard deviation Vdσ comprehensively. FIG. 14 shows an example of the generation frequency distribution characteristics of the volume Vd of the ink droplets 5 at this juncture (corresponding to FIG. 11 in the first embodiment).

Here, in the foregoing first embodiment and second embodiment, the description has been made of an event in which a recording head 21 having eight nozzles, 2 per mm, is employed, but the present invention is not limited thereto. In general, the higher the density of the nozzle arrangement, that is, the higher the recording density, the more is the recording quality improved. In the recording method according to the present invention, too, the higher the recording density, the lesser becomes the roughness brought about microscopically by the volume Vd of the ink droplets 5 which varies at random. Thus, the quality of the recording image is more improved.

Also, in the foregoing first embodiment, the voltage is made constant, V1=V2, as shown in FIG. 8. Also, the pulse width T1 and the pulse interval T3 are made constant, respectively, but only the width of the second pulse width T2 is made variable at random. The present invention is not necessarily limited thereto. For example, it may be possible to vary only the pulse interval T3 at random while the voltage is made constant, V1=V2, and the pulse widths T1 and T2 are also constant, respectively. Also, an arrangement may be made so that while the voltage V1 is constant, and the pulse widths T1 and T2, and the pulse interval T3 are also constant, respectively, only the voltage V2 can be varied at random. Furthermore, the arrangement may be made so that at least two or more of them are combined and varied at random.

Also, in the first embodiment, the heat generating elements 3 are driven in order of the second pulse 16 and the first pulse 15 only when the recording data are present in the recording operation, but it may be possible to obtain some other effect if only the second pulse 16 is driven when no recording data is present in the recording operation, that is, the pixels which are not recorded are driven only by this pulse. The width of the second pulse 16 is assumed to be T2=4 μsec. Some other effect means that the difference is made small in temperature of the ink 20 in the vicinity of the heat generating elements 3 in the nozzles 2 when the recording data are present and absent. If the temperature difference is great, the temperature in the nozzles 2 which are engaged in a continuous recording becomes higher than that in those engaged in an intermittent recording, and those having the higher ink temperature discharge the ink droplets 5 in a greater volume Vd. Because of this, the recorded image becomes uneven as a whole. From the above, therefore, applying the second pulse 16 at all times enables the quality of the recorded image to be improved eventually.

Furthermore, when a recording apparatus using this recording method is actuated for a recording operation, at the time of warming up, for example, applying only the second pulse 16 results in the better quality of recorded image the moment the recording is started for the same reason as above. The ink 20 is not discharged by the application of the second pulse 16 alone.

In this respect, the essence of the present embodiment according to the present invention is that the volume Vd of the ink droplets 5 discharged from each of the nozzles is randomized so that the standard deviation of its distribution is made 9.0% or more, for example. Thus, the means employed for this objective is not limited to those described in each of the foregoing embodiments, and as means for transducing the electrical energy to the ink discharging energy, a method for changing the pulse widths of the driving pulse is employed in each of the foregoing embodiments, but it may be possible to adopt a method for changing voltage values. Further, it may be possible to use an additional circuit without any problem if only such a circuit is capable of finely varying the electrical energy to be provided.

Also, there has been known the so-called error diffusion method in which the recording points are diffused as a whole by processing the digital gradient recording data, but in the recording using a method of the kind, the volume of the ink droplets discharged from the same nozzle is always constant. This is completely different from the present invention wherein the volume of the discharging ink droplets is varied at random.

Third Embodiment

Subsequently, a third embodiment will be described. In this respect, the fundamental structure and the related art are exactly the same as those used in the first and second embodiments. The present embodiment will be described by partly sharing the drawings used for the first and second embodiments.

The structure of the recording head which will be used for the present embodiment is the same as that of the one shown in FIG. 2. On the head substrate 10, a plurality of the heat generating elements 3 and nozzles 2 corresponding to the plural heat generating elements 3, respectively. The nozzles 2 are provided in a density of eight per mm, and 2,048 nozzles are arranged in total in the direction perpendicular to the surface of FIG. 10. The heat generating elements 3 are arranged on the head substrate 10 with a protective film 8 of $SiO_2$ so that the elements are not in contact with ink directly. The heat generating elements 3 and the head driving circuit 4 are electrically connected by lead lines 17 and wiring formed flatly on the head substrate 10. The inputted electrical energy is partly transduced to the ink discharging energy which causes ink droplets 5 to be discharged from the nozzles 2.

The characters and images are recorded as given below. Each of the heat generating elements 3 is selectively driven as required by the head driving circuit 4 to generate heat. When the heat generating elements 3 generate heat, bubbles are created in the nozzles 2. With the development of the bubbles, the ink droplets 5 are discharged forwardly from the nozzles 2. The discharged ink droplets 5 fly toward a transfer sheet which is a recording medium 11 to form characters and images. Since the ink droplets 5 are discharged with the development of the bubbles like this, the head is called thermal jet recording head (TJ recording head).

In the present embodiment, the driving waveforms which cause the heat generating elements 3 to generate heat are rectangular waves, and its voltage value is constant. Also, the driving waveform Pw is constantly 10 $\mu$sec. The head substrate 10 is made of a glass of approximately one mm thick, No. 7059 manufactured by Corning Inc. This glass material has a heat conductivity of KGI=1.26 E-2J/cm sec. k.

Also, the composition of the ink used is as given below. In other words, the ink contains at least 4 to 50 weight % of oxyethylene addition polymer and/or triol; the viscosity of the ink is 3.0 cP or less at 25° C.; and the surface tension is 55 dyne/cm or more.

Also, the other ink contains at least 4 to 50% oxyethylene addition polymer and/or triol, and 0.1 to 10% alkyl alcohol of carbon numbers one to 4 or halogen derivative, and the viscosity of the ink is 2.0 cP or more at 25° C.

Also, the above-mentioned ink should preferably contain further at least 0.1 to 10% hydrogen content heterocyclic compound and/or thiodiglycol. The recording unevenness due to the disequilibrium of the mean value Vdm of the volume of the ink droplets discharged from each of the nozzles has hitherto been a problem, but it has been solved by the use of the above-mentioned ink.

Further, the other composition of the ink used is such that at least 6 to 50% of oxyethylene addition polymer and/or triol and 0.001 to 2% interfacial activator are contained. Also, the above-mentioned ink should preferably contain further 0.1 to 15 weight% of alkyl alcohol of carbon numbers one to four or its halogen derivative.

The recording unevenness due to the disequilibrium of the mean value Vdm of the volume of the ink droplets discharged from each of the nozzles, which has hitherto been a problem, is solved by adding an appropriate amount of interfacial activator to the ink. The preferable solvent used for the present invention is water or a mixed solvent of water and water soluble solvent. Particularly, a mixed solvent of water and water soluble solvent is preferable. Especially, the oxyethylene addition polymer and triol are the components which can be used effectively to prevent the nozzles from being clogged.

As the oxyethelene addition polymer, there can be named diethylene glycol, triethylene glycol, tetraethylene glycol, polyethylene glycol, or the like. As the triol, 1-, 2-, and 6-hexane triol, glycerin, or the like can be named.

These elements function as a wetting agent even when each of them is used independently, but being combined with the oxyethylene addition polymer and triol, these demonstrate a particular effect in preventing the nozzles from being clogged. The load of the foregoing solvent in ink should be 4 to 50%, and preferably 6 to 30%.

When the above-mentioned conditions are satisfied, it is possible to vary the volume Vd of the ink droplets from a specific nozzle at random within a certain width $\sigma$ while maintaining the performability of ink such as the prevention of clogging and others.

For the ink used for the present invention, it is preferable to make its viscosity 3 cP or less at 25° C. and adjust its surface tension at 55 dyne/cm or more as the physical properties of the ink itself in order to discharge the ink droplets from the TJ recording head stably for a long time. Therefore, the water content in the ink should be 50% or more, preferably 60% or more, or more preferably 70% or more for the adjustment of the above-mentioned ink.

If the above-mentioned conditions, that is, the ink discharged from the foregoing nozzles contains at least 4% to 50% oxyethylene addition polymer and/or triol; the viscosity of the ink is 3.0 cP or less at 25° C.; and the surface tension is 55 dyne/cm or more, it is possible to vary the volume Vd of the ink droplets discharged from a specific nozzle with a certain width σ while maintaining the every performability of the ink such as the prevention of clogging.

Also, for the ink, it may be possible to combine another water soluble organic solvent generally used. For example, the following can be named as an organic solvent which can be combined to the oxyethylene addition polymer and triol, amide group such as dimethylhormamide, and dimethylacetamide; ketone or ketone alcohol group such as acetone and diacetone alcohol; ether group such as tetrahydrofuran and dioxane; oxypropylene addition polymer such as dipropylene glycol, tripropylene glycol, and polypropylene glycol; alkylene group containing the carbon atom of two to six alkylene glycol such as ethylene glycol, propylene glycol, trimethylene glycol, buthylene glycol, and hexalene glycol; thiodiglycol; lower alkylether of polyvalent alcohol such as ethylene glycol monomethyl (or ethyl) ether, diethylene glycol monomethyl (or ethyl) ether, and triethylene glycol monomethyl (or ethyl) ether; lower dialkylether of polyvalent alcohol such as triethylene glycol dimethyl (or ethyl) ether, tetraethylene glycol dimethyl (or ethyl) ether; sulfone; hydrogen content heterocyclic compounds such as N-methyl-2-pyrrolidone, 2-pyrrolidone, and 1, 3-dimethyl-2-imidazolidinon; and others, but not limited to these organic solvents.

The content of each of the above-mentioned water soluble organic solvents is generally 0.5 to 50% against the total weight of the ink, and is preferably within a range of 1 to 30%. In order to enhance the ink discharging efficiency at the time of ink droplets discharging, alkyl alcohol of one to four carbon numbers or its halogen derivative is added. These kinds of alcohol may also have functions to suppress the ink spreading while enhancing the permeability of the ink when it is used for printing on an ordinary sheet such as a copying sheet and bond sheet.

As the alkyl alcohol of one to four carbon numbers or its halogen derivative, there can be named methyl alcohol, ethyl alcohol, n-propyl alcohol, isopropyl alcohol, n-butyl alcohol, sec-butyl alcohol, tert-butyl alcohol, isobutyl alcohol, and others.

The load of these kinds of alcohol depends on the numbers of carbon, but it is preferable that if the carbon number is one, the load is 15% or less, 2, 10% or less, 3, 5% or less, and 4, 3% or less. If the load exceeds these percentages, the foaming is extremely stabilized, and it becomes impossible to obtain the Vdσ aimed at by the present invention.

In this respect, the physical properties of the above-mentioned ink should be adjusted as given below in order to enable the TJ recording head to discharge the ink droplets stably for a long time: the viscosity is 2 to 15 cP at 25° C., preferably 2 to 10 cP, and more preferably 2 to 5 cP, and the surface tension is 45 to 68 dyne/cm, preferably 50 to 68 dyne/cm, and more preferably 54 to 68 dyne/cm.

Therefore, in order to adjust the above-mentioned ink, the water content in the ink should be 50% or more, preferably 55% or more, and more preferably 60% or more to optimize the adjustment.

When the above-mentioned conditions, that is, the ink discharged from the foregoing nozzles contains at least 4 to 50% oxyethylene addition polymer and/or triol, 0.1 to 10% alkyl alcohol of one to four carbon numbers or its halogen derivative, and the ink viscosity is 2.0 cP (F) or more at 25° C., are satisfied, it is possible to vary the ink droplets discharged from a specific nozzle at random with the width Vdσ while maintaining the every performability of the ink such as the prevention of clogging.

Any kinds of interfacial activator may be used effectively for the present invention, but the interfacial activators of nonion group particularly effective. Among them, the one produced by adding ethylene glycol (EO) to acetylene glycol is more effective. Further, it is especially effective if the addition number of the ethylene oxide is approximately 10.

As the coloring matter which constitutes the ink, there can be used a direct dye, acid dye, basic dye, food dye, reactive dye, disperse dye, vat dye, soluble vat dye, reaction disperse dye, oil dye, and various kinds of pigments. It is particularly preferable to use a water soluble dye for the ink to be employed for an ink jet recording head.

Although the load of these coloring matters is determined depending on the kinds of the composition of the liquid solvent, the characteristics required for the ink, and the like, its load should be within a occupying ratio of approximately 0.2 to 20% against the total quantity of the ink in general or preferably 0.5 to 10%, or more preferably, 1 to 5%.

Figure 15:
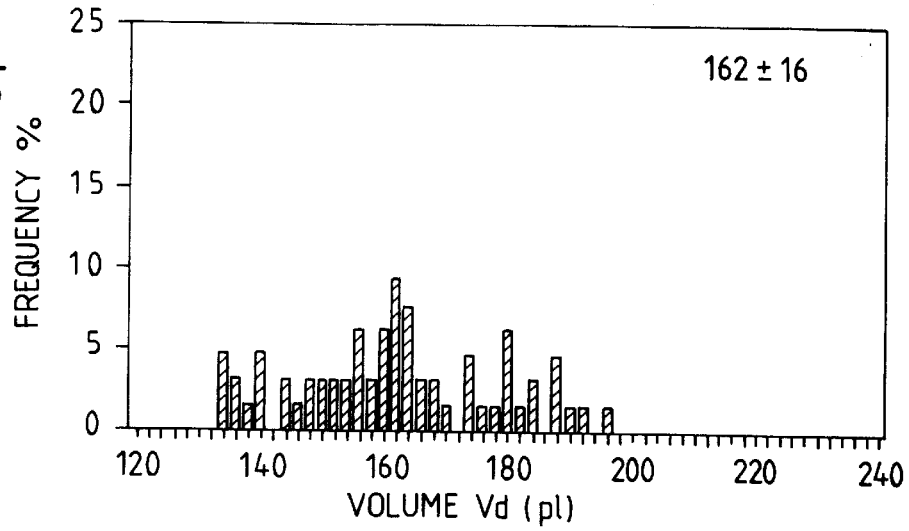
FIG. 15 is a view showing an example of the frequency distribution of the volume of the ink droplets discharged from the nozzle according to the present invention.

FIG. 15 shows the generation frequency (%) of the volume Vd of the ink droplets discharged from a specific nozzle when an ink 1 of the present invention stated in Table 4 (I) which will be described later. The frequency of the ink discharge is 800 Hz. The ratio of the standard deviation of the volume Vd of the ink droplets discharged is approximately 9.9%.

Figure 16:
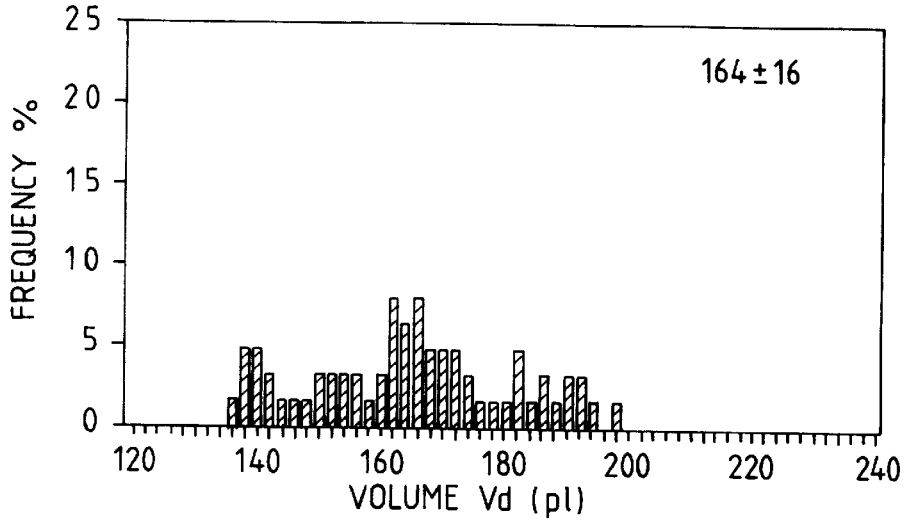
FIG. 16 is a view showing an example of the frequency distribution of the volume of the ink droplets discharged from the nozzle according to the present invention.

FIG. 16 shows the generation frequency (%) of the volume Vd of the ink droplets discharged from a specific nozzle when an ink 6 of the present invention stated in Table 4 (II). The frequency of the ink discharge is 800 Hz. The ratio of the standard deviation of the volume Vd of the ink droplets discharged is approximately 9.8%.

Here, in order to discharge the ink droplets from the nozzles of the recording head stably at all times, the physical properties of the ink should preferably be adjusted so that its surface tension is 30 to 68 dyne/cm and viscosity is 15 cP or less at 25° C., or more preferably 5 cP or less. Therefore, the water content in the ink should be 50% or more, preferably 60% or more, or more preferably 70% for the optimal adjustment of the above-mentioned ink.

Figure 17:
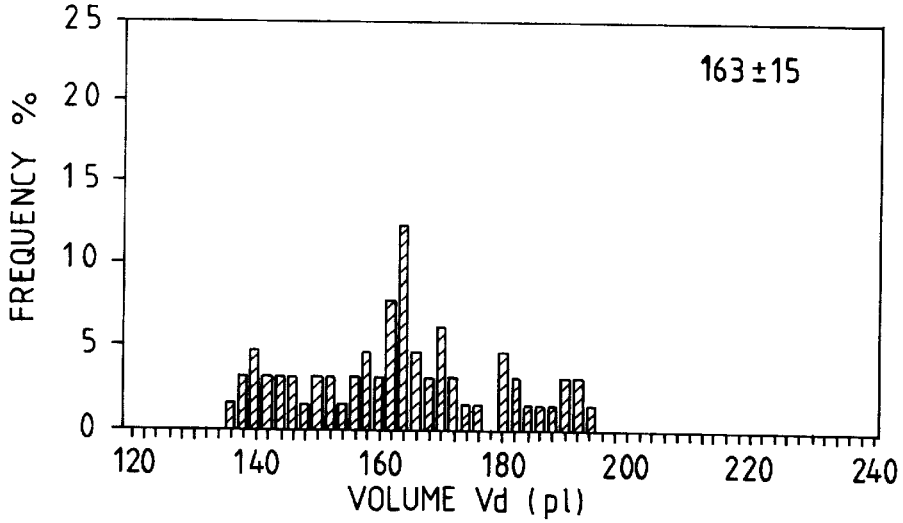
FIG. 17 is a view showing an example of the frequency distribution of the volume of the ink droplets discharged from the nozzle according to the present invention.

FIG. 17 shows the generation frequency (%) of the volume Vd of the ink droplets discharged from a specific nozzle (254th bit) when the ink 11 of the present invention stated in the Table 4 (III). the frequency of the ink discharge is 800 Hz. The ratio of the standard deviation of the volume Vd of the ink droplets discharged is approximately 9.2%. Thus, the volume Vd of the ink droplets from each of the nozzles varies, and it becomes difficult to discriminate the size, large or small, of the mean value of the volume Vd of a specific nozzle.

Figure 18:
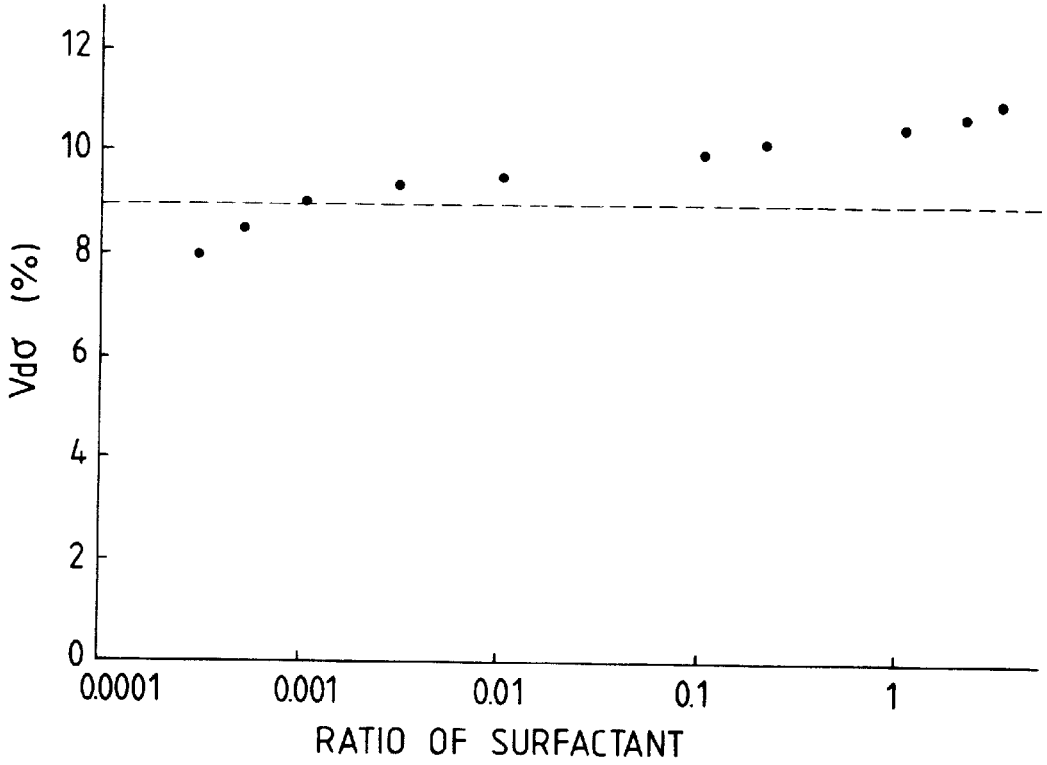
FIG. 18 is a view showing the value of standard deviation for the variation of the volume of ink with respect to the loading ratio of the interfacial activator of the ink according to the present invention.

FIG. 18 shows the ratio of the standard deviation Vdσ (%) of the varying volume Vd of the discharged ink droplets 5 with respect to the ratio of the addition of the interfacial activator of the nonion group in which 10 ethylene oxide is added to acetylene glycol. The Vdσ is the mean value of the standard deviation calculated by measuring the 1,024 ink droplets from each nozzle of n=32.

From this experiment, it is found that the load of the interfacial activator in the ink should be 0.001% or more for a better result. On the other hand, if such a load exceeds 2%, the ink spreads along the fine texture of the recording medium when it shots the medium, that is, the so-called feathering phenomenon tends to occur. Thus, such a side effect is created to degrade the quality of characters and images in recording. Hence, the load of the above-mentioned interfacial activator in the ink should be 0.001 to 2%, or preferably 0.01 to 1%, or more preferably 0.01 to 0.2%.

Figure 7:
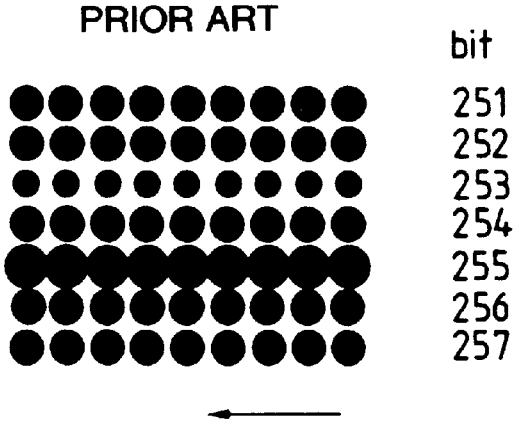
FIG. 7 PRIOR ART
FIG. 7 is a schematic view showing an example of an image formed by the application of a recording method according to the prior art.
Figure 19:
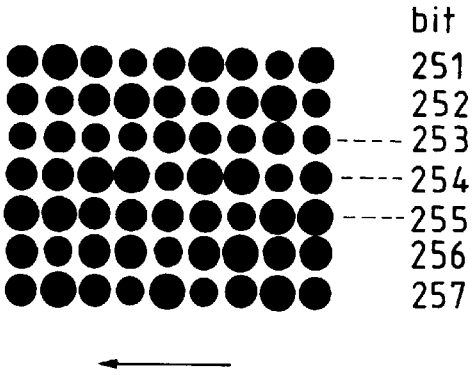
FIG. 19 is a view showing an example of an image recorded by the application of a recording method according to the present invention.

FIG. 19 shows the recording result of the present embodiment. As in the results of the first and second embodiments, the recording unevenness which is clearly visible in the correlative shifting direction of the recording medium 11 and the recording head 21 as shown in FIG. 7 is now inconspicuous. In other words, the recording quality is improved.

As described above, the volume Vd of the ink droplets discharged from each of the nozzles is not confined to a comparatively narrow range of a fixed value, but is distributed over a wide range when the droplets are discharged. As a result, although the recorded characters and images appear rough by the microscopic observation with attention given to each of the ink droplets and at a glance, the recording quality appears inferior, it is possible to judge that the recording quality has rather improved from the comprehensive point of view.

This judgment becomes more clear if the object is observed from a position slightly away (the distance between the recorded object and the eyes of an evaluator is 25 cm or more if the recording is made in a density of eight points per mm).

If any specific pattern is present on this varying volume of the ink droplets, such a pattern appears as a comprehensive unevenness. Therefore, it is prerequisite that there is no specific pattern with respect to the varying volume, that is, the variation must be randomized. In the present embodiment, the volume Vd of the ink droplets from each of the nozzles is not specific, but is random.

In this respect, the load of each solvent, alcohol, and interfacial activator in the ink is finely adjusted among others. Then, with the value of the standard deviation set at 8.0%, 8.5%, 9.0%, and 9.5%, tests are conducted on the varying volume. As a result, it is determined that with 9.0% or more, the varying volume is practically sufficient enough according to the judgment described above.

Also, the outline of a method for manufacturing the ink (ink 1) used for the present invention is as follows:

Each of the components shown in Table 4 (I) is mixed and after five hours, the pH of the mixture is adjusted to 7.5 by a water solution containing sodium hydroxide of 0.1 % and then, filtered under pressure by use of a membrane filter (Commercial name: Fluoropour filter—Sumitomo Denko Inc.) having a pour size of 0.22 $\mu$m so that the respective kinds of ink are prepared. To the preparation method of the above-mentioned ink, it is possible to apply any one of the prior arts of the kind.

The volume Vd of each one of the ink droplets 5 discharged is measured by a measuring system comprising a microscope provided with a strobe flash and a CCD camera. An image processing is provided for the image of the ink droplet photographed by the CCD camera.

Using an appropriately selected ink for an ink jet head having a plurality of ink discharging nozzles, the volume Vd of the discharging ink droplets is varied at random. Conceivably, this is because of the fact that the micro bubbles which remain in the pressure chamber 9 of the recording head 21 in a repeated ink discharging due to the residual gaseous solution and the like in the last (the prior) ink discharging will cause the initial foaming condition of the following (the next) discharging to be varied. It is anticipated that the additives to the ink and the ink composition affect the numbers and sizes of this minute residual gaseous solution and the like.

Fourth Embodiment

The effect obtainable by the use of ink 1 shown in the third embodiment is also obtained by use of ink 2 to 15 shown in Tables 4 (I), 4 (II), and 4 (III), respectively. On the other hand, the ink 16 to 19 which are used as comparison examples shown in Table 5 do not provide the effect as the embodiments.

The composition of the ink according to the embodiments is as described above, but it is possible to load the various dispersants, viscosity adjustors, surface tension adjustors, fluorescent brighteners, and others within a range which does not affect the objectives of the present invention. For example, there can be named the viscosity adjustor such as polyvinyl alcohol, cellulose group, and water soluble resins; the surface tension adjustor such as diethanol amine and triethanol amine; the pH adjustor on the basis of buffering agents; mildewproofing agents, and others.

In the embodiments, the description has been made of a recording head having eight nozzles per mm, the present invention is not limited thereto. Generally, the higher the density of the nozzle arrangement, that is, the higher the recording density, the more is the recording quality improved. Also, in the recording method according to the present invention, the higher the recording density, the lesser becomes the microscopic roughness due to the random variation of the ink droplet volume; thus enabling the quality of image recorded to be more improved.

In the embodiments, the description has been made of a specific example in which a glass material No. 7059 of 1 mm thick manufactured by Corning Inc. is used for the recording head substrate 10, but it is possible to obtain the same results as the embodiments by the use of a TJ recording head using a pyrex which is the most common glass material. Also, almost the same effect is obtainable by the use of a silicon head substrate.

Also, in the recording method according to the embodiments, the description has been made of an example in which the ink droplets discharged from the recording head are either discharged toward the recording medium or not, but in an example of the so-called multi-droplet method where the ink discharging is executed plural times toward substantially a same position on the recording medium, the volume of ink which forms one dot is varied at random for each of the dots; thus resulting in the reduction of the recording unevenness and demonstrating the effect anticipated for the present invention.

In the embodiments, the description has been made of the head driving circuit by the use of the conventional one which is shown in FIG. 2, but the present invention is not limited thereto. It may be possible to combine the circuit with the methods described in the first and second embodiments wherein the energy given to the heat generating elements is varied at random when the ink is discharged. Using the ink shown in Table 3 and Table 4, and further. Varying the energy provided for the heat generating elements, the volume of the discharging ink droplets is varied. Hence, an image is formed by the dots varied at random so that the recording unevenness is prevented.

As the specific methods for varying the ink droplet volume, there is the one as described in the foregoing embodiments that the pulse width of the rectangular driving pulses provided for the heat generating elements 3 is varied and/or the voltage value is varied, or the pulse width of the pulses which are applied immediately before the provision of the pulses for discharging ink droplets, but not strong enough to execute any ink discharging, is varied, among others.

TABLE 4 (I)

(Ink Composition I of the Embodiment)

| | | |
|---|---|---|
| Ink 1 | C.I. food black 2 | 3 parts |
| | Triethylene glycol | 7 parts |
| | 1, 2, and 6 hexane triol | 7 parts |
| | Water | 83 parts |
| | Surface tension 63 dyne/cm Viscosity 2.0 cP | |
| Ink 2 | C.I. direct yellow 86 | 2 parts |
| | Triethylene glycol | 10 parts |
| | 1, 2, and 6 hexane triol | 6 parts |
| | Water | 82 parts |
| | Surface tension 58 dyne/cm Viscosity 2.1 cP | |
| Ink 3 | C.I. direct black 154 | 2 parts |
| | Diethylene glycol | 8 parts |
| | 1, 2, and 6 hexane triol | 6 parts |
| | Water | 84 parts |
| | Surface tension 59 dyne/cm Viscosity 1.9 cP | |
| Ink 4 | C.I. direct blue 199 | 2.5 parts |
| | Diethylene glycol | 11 parts |
| | Glycerin | 4 parts |
| | Water | 82.5 parts |
| | Surface tension 59 dyne/cm Viscosity 2.0 cP | |
| Ink 5 | C.I. direct yellow 86 | 2 parts |
| | Diethylene glycol | 15 parts |
| | Water | 83 parts |
| | Surface tension 63 dyne/cm Viscosity 1.8 cP | |

TABLE 4 (II)

(Ink Composition II of the Embodiment)

| | | |
|---|---|---|
| Ink 6 | C.I. direct yellow 86 | 2 parts |
| | Triethylene glycol | 10 parts |
| | 1, 2, and 6 hexane triol | 8 parts |
| | Isopropyl alcohol | 1 part |
| | Water | 79 parts |
| | Surface tension 56 dyne/cm Viscosity 2.2 cP | |
| Ink 7 | C.I. food black 2 | 3 parts |
| | Triethylene glycol | 7 parts |
| | 1, 2, and 6 hexane triol | 5 parts |
| | Thiodiglycol | 3 parts |
| | 2-pyrrolidone | 3 parts |
| | Isopropyl alcohol | 1 part |
| | Water | 78 parts |
| | Surface tension 57 dyne/cm Viscosity 2.1 cP | |
| Ink 8 | C.I. direct black 154 | 2 parts |
| | Triethylene glycol | 8 parts |
| | glycerin | 6 parts |
| | 2-pyrrolidone | 4 parts |
| | Ethanol | 3 parts |
| | Water | 77 parts |
| | Surface tension 57 dyne/cm Viscosity 2.2 cP | |
| Ink 9 | C.I. direct blue 199 | 2.5 parts |
| | Diethylene glycol | 13 parts |
| | Glycerin | 4 parts |
| | Thiodiglycol | 3 parts |
| | 2 butanol | 1 part |
| | Water | 76.5 parts |
| | Surface tension 58 dyne/cin Viscosity 2.2 cP | |
| Ink 10 | C.I. direct yellow 86 | 1.5 parts |
| | Diethylene glycol | 36 parts |
| | 2 butanol | 1 part |
| | Water | 61.5 parts |
| | Surface tension 54 dyne/cm Viscosity 3.2 cP | |

TABLE 4 (III)

(Ink Composition III of the Embodiment)

| | | |
|---|---|---|
| Ink 11 | C.I. food black 2 | 3 parts |
| | Triethylene glycol | 5 parts |
| | 1, 2, and 6 hexane triol | 7 parts |
| | 2 butanol | 1 part |
| | Nonion interfacial activator (with 10 acetylene glycol EO loaded) | 0.04 part |
| | Water | 83.96 parts |
| Ink 12 | C.I. direct yellow 86 | 2 parts |
| | Triethylene glycol | 7 parts |
| | 1, 2, and 6 hexane triol | 8 parts |
| | Isopropylene alcohol | 2.5 parts |
| | Nonion interfacial activator (with 10 acetylene glycol EO loaded) | 0.02 part |
| | Water | 80.48 parts |
| Ink 13 | C.I. direct black 154 | 2 parts |
| | Triethylene glycol | 8 parts |
| | glycerin | 6 parts |
| | Ethanol | 3 parts |
| | Nonion interfacial activator (with 10 acetylene glycol EO loaded) | 0.08 part |
| | Water | 80.92 parts |
| Ink 14 | C.I. direct blue 199 | 2.5 parts |
| | Diethylene glycol | 10 parts |
| | Glycerin | 5 parts |
| | Nonion interfacial activator (with 10 acetylene glycol EO loaded) | 0.1 part |
| | Water | 82.4 parts |
| Ink 15 | C.I. direct yellow 86 | 2 parts |
| | Diethylene glycol | 15 parts |
| | Isopropylene alcohol | 3 parts |
| | Nonion interfacial activator (with 10 acetylene glycol EO loaded) | 0.12 part |
| | Water | 79.88 parts |

TABLE 5

(Ink Composition of the Comparison Example)

| | | |
|---|---|---|
| Ink 16 | C.I. direct yellow 86 | 2 parts |
| | Diethylene glycol | 15 parts |
| | Isopropyl alcohol | 4 parts |
| | Water | 79 parts |
| | Surface tension 49 dyne/cm Viscosity 1.8 cP | |
| Ink 17 | C.I. acid red 35 | 2 parts |
| | Diethylene glycol | 35 parts |
| | Water | 63 parts |
| | Surface tension 56 dyne/cm Viscosity 3.3 cP | |
| Ink 18 | C.I. food black 2 | 3 parts |
| | Triethylene glycol | 5 parts |
| | 1, 2, and 6 hexane | 7 parts |
| | 2 butanol | 1 part |
| | Water | 84 parts |
| | Surface tension 54 dyne/cm Viscosity 1.8 cP | |
| Ink 19 | C.I. direct blue 199 | 2.5 parts |
| | Glycerin | 5 parts |
| | Thiodiglycol | 4 parts |
| | Uria | 6 parts |
| | N butanol | 2 parts |
| | Water | 80.5 parts |
| | Surface tension 48 dyne/cm Viscosity 1.8 cP | |

Fifth Embodiment

Furthermore, the research and experiments are repeated to determine the load of the surface sizing agent which can be shared by the ink jet recording method of an ink jet, a thermal jet, or the like, and by the electronic photographing. As a result, it is found that an excellent image quality is obtainable within a range of 0.8 to 3.9% of the starch loading ratio. Hereinafter, the description will be described in detail of the embodiments according to the present invention, but the invention is not limited to these embodiments.

With a usual neutral papering method, four kinds of transfer sheets (Examples A to D) well prepared having the physical properties shown in Table 6 using the filler, pulp cellulose, and sizing agent also shown in the Table 6. The above-mentioned four kinds of the. transfer sheets are set in a printer of a thermal jet type, respectively, to evaluate the degree of ink spread on each of the transfer sheets. In this respect, an LBKP shown in the Table 6 represents a broad-leaved bleached pulp. The above-mentioned four kinds of transfer sheets are also set on a copying machine of a cleaning blade type to evaluate the effects produced on the copied images such as black specks and black streaks.

Regarding the degree of the ink spreads, a printing is executed on each of the above-mentioned four kinds of transfer sheets by use of a thermal jet printer, and the degree of the ink spreads is visually observed. When the result is excellent without any ink spreading, a mark "○" is given; if there is any spreading, although slightly, a mark "Δ"; and if conspicuous, a mark "X"

Further, regarding the degree of smears on the photosensitive elements, the above-mentioned copying machine is used to copy 10,000 sheets each of the four kinds of transfer sheets A to D under an environment of 32.5° C./85%. Then, the black specks and black streaks both on the copied images and the surface of the photosensitive elements are visually observed. When there is no smear, a mark "○" is given; if there is a slight smear, a mark "Δ"; and if conspicuous, a mark "X" is given for the evaluation.

As the results of the evaluation shown in the Table 6 indicate, the transfer sheets A to C for which the load of the starch is set at 3.9% or less produce a practically good image quality, that is, there is no black speck or black streak, or copied images having them slightly. Further, the transfer sheets B to D for which the load of the starch is set at 0.8 % or more produce a practically good image quality, that is, almost no spread on the printed images.

As another embodiment, the transfer sheets are prepared by using an acid papering method wherein talc and kaolin are used for the filler, and a rosin sizing agent is used as the inner sizing agent for them, and the same kinds of tests are conducted with arranging the load of the surface sizing agents as the examples A to D shown in the Table 6. The same results are also obtainable.

Also, it is possible to obtain the images having particularly an excellent quality both on an ink jet printer of an ink jet recording type and a copying machine of an electronic photographing type using the transfer sheets (Examples B and C in the Table 6) prepared by the application of the surface sizing agent according to the present invention, particularly those having its starch load of 0.8 to 3.9%.

TABLE 6

| | EMBODIMENTS | | | |
|---|---|---|---|---|
| | A | B | C | D |
| Composition | | | | |
| surface sizing agent | starch 0.5% | starch 0.8% | starch 3.90% | starch 4.50% |
| filler | calcium carbonate | calcium carbonate | calcium carbonate | calcium carbonate |
| kinds of pulp | LBKP 100% | LBKP 100% | LBKP 100% | LBKP 100% |
| inner sizing agent | alkylketone dyemer | alkylketone dyemer | alkylketone dyemer | alkylketone dyemer |

TABLE 6-continued

| | EMBODIMENTS | | | |
|---|---|---|---|---|
| | A | B | C | D |
| Physical properties | | | | |
| basis weight ($g/m^2$) | 64 | 64 | 64 | 64 |
| Evaluation | | | | |
| degree of smear on photosensitive element | ○ | ○ | ○ or Δ | x |
| degree of ink spread | x | ○ or Δ | ○ | ○ |

Other Embodiments

Figure 20:
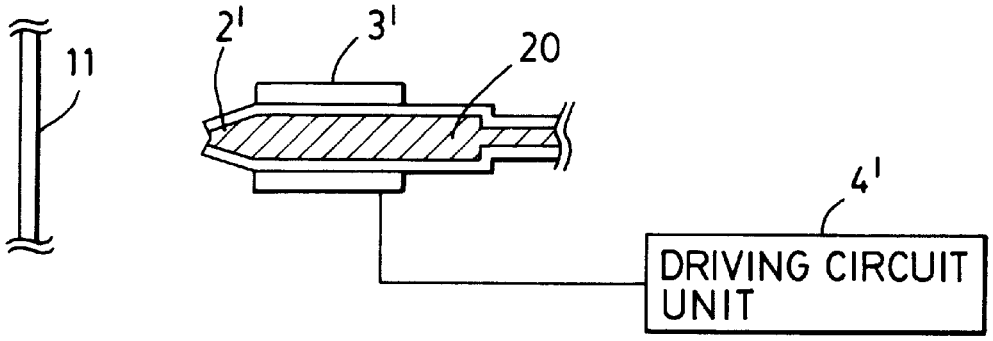
FIG. 20 is a view schematically showing the structure of a recording head and the driving unit of the head according to another embodiment of the present invention.

Also, in each of the foregoing embodiments, the description has been made of an example in which the means which transduces the electrical energy to the energy used for discharging ink is the heat generating elements 3. The present invention is not limited thereto. For example, using piezoelectric elements, it may be possible to obtain the same effect by varying the driving electrical energy at random within a range where the ink discharge can be executed. An example of the present invention utilizing piezoelectric elements is shown in FIG. 20. This embodiment is similar to the previous embodiments but the heat generating element 3 is replaced with a piezoelectric element 3' to eject the ink out of a nozzle 2'. The piezoelectric element 3' is driven by driving circuit 4'.

The driving waveform for the ink jet recording head according to the present invention is applicable to the above-mentioned piezoelectric elements, and all the embodiments disclosed in the present invention are sufficiently applicable to an ink jet printer which discharges ink by the use of the piezoelectric elements.

Among the ink jet recording methods, the present invention produces excellent effects particularly when it is applied to the recording head and recording apparatus of the type which utilizes thermal energy.

Regarding the typical structure and operational principle of such a method, it is preferable to adopt those which can be implemented using the fundamental principle disclosed in the specifications of U.S. Pat. Nos. 4,723,129 and 4,740,796. This method is applicable both to the so-called on-demand type recording system and a continuous type recording system. Particularly, however, it is suitable for the on-demand type system because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with a remarkably quick response.

The driving signal in the form of pulses is preferably such as disclosed in the specifications of U.S. Pat. Nos. 4,463,359 and 4,345,262. In addition, the temperature increasing rate of the heating surface is preferably such as disclosed in the specification of U.S. Pat. No. 4,313,124 for an excellent recording in a better condition.

The structure of the recording head may be as shown in each of the above-mentioned the specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also effective for the present invention. In addition, the present invention is effective for the structure disclosed in Japanese Laid-Open Application No. 59-123670 wherein a common slit is used as the discharging ports for plural electrothermal transducers, and also for the structure disclosed in Japanese Patent Laid-Open Application No. 59-138461 wherein an opening for absorbing the pressure wave of the thermal energy is formed corresponding to the discharging ports.

Effect of the Invention

As described above, according to the present invention, the driving pulses of the electrical energy applied to each of the discharging ports are varied at random in the recording head of an ink jet recording apparatus having a plurality of nozzles. Then, the volume of the ink droplets discharged from each of the discharging ports is minutely varied at random so that the unevenness of recording made by the discharging ports is eliminated even when the average amount of ink discharged from each of the nozzles slightly fluctuates, or the unevenness of recording is made inconspicuous, hence making it possible to execute recording in a high recording quality as a whole. Also, it is possible to use a recording head having the properties with which to slightly vary the ink discharging volume of each of the discharging ports. As a result, the production yield of the recording heads is improved, thus enabling the recording heads to be provided at a lower cost.

Using a plurality of the heat generating elements arranged on a head substrate, a TJ recording head provided with a plurality of nozzles corresponding to these heat generating elements as well as a specific ink and transfer sheet, the volume of ink droplets discharged from each of the nozzles is varied at random so that the unevenness of recording made by the nozzles is eliminated even when the average amount of ink discharged from each of the nozzles is slightly varied or the unevenness is made inconspicuous, hence making it possible to execute recording in a high recording quality as a whole. Also, it is possible to use a recording head having the properties with which the ink discharging volume from each of the nozzles differs slightly. As a result, it becomes possible to provide recording heads in a good production yield, hence at a lower cost of production.

According to the present invention, there are arranged as main components of a transfer sheet, the pulp cellulose which serves as the transferring agent, sizing agent, and filler, and the surface sizing agent, the starch of which is loaded particularly in a parsentage of 0.8 to 3.9% as set forth above, thus making both transfer sheets for the use of an ink jet printing and an electronic photographing commonly usable. It is, therefore, possible for these two types of recording to obtain an excellent image by use of only a single transfer sheet, respectively.

What is claimed is:

1. An ink jet recording apparatus for recording with an ink jet recording head having a plurality of discharge ports for discharging ink and discharge means provided corresponding to each of the discharge ports to cause the ink to discharge through a corresponding discharge port in response to application of drive signals, said apparatus effecting recording by discharging the ink onto a recording medium from the ink jet recording head, said apparatus comprising:

pulse control means for controlling a driving signal to be applied to the discharge means and changing an amount of an ink droplet discharged from the discharge port corresponding to the discharge means, said pulse control means for individually changing the amount of the ink droplet discharged from each of the plurality of discharge ports; and discharge amount control means for changing at random a driving signal applied to each of the plurality of discharge means by said pulse control means in accordance with image data to be recorded and driving the plurality of discharge means, said discharge amount control means controlling so as to change at random the amount of the ink droplet discharged from each of the plurality of discharge ports, wherein said discharge amount control means differentiates an amount of variation in the discharge amount in accordance with a frequency of discharge represented by the image data.

2. An ink jet recording apparatus according to claim 1, wherein said discharge amount control means makes an amount of variation in the discharge amount greater as the frequency of discharge represented by the image data becomes higher.

3. An ink jet recording apparatus according to claim 1, wherein said pulse control means varies a pulse width of the drive signal.

4. An ink jet recording apparatus according to claim 1, wherein said pulse control means varies a voltage value of the drive signal.

5. An ink jet recording apparatus according to claim 1, wherein the discharge means generates heat energy to effect a change of state of ink in the discharge ports, the change of state creating a bubble and causing the ink to be displaced and discharged from the discharge ports.

6. An ink jet recording apparatus according to claim 1, wherein the discharge means comprises piezoelectric elements which transduce the drive signals to generate pressure in ink in the discharge ports, the pressure displacing the ink and causing the ink to be discharged from the discharge ports.

7. An ink jet recording apparatus according to claim 1, wherein said discharge amount control means differentiates at random the discharge amount only in a case the frequency of discharge represented by the image data is high.

8. An ink jet recording apparatus according to claim 1, wherein each of the drive signals comprises a first pulse for discharging ink, and a second pulse, and energy of the second pulse is smaller than that of the first pulse.

9. An ink jet recording apparatus according to claim 8, wherein said pulse control means varies a time interval between applications of the first pulse and the second pulse.

10. An ink jet recording apparatus according to claim 8, wherein the discharge means comprises piezoelectric elements which transduce the drive pulses to generate pressure in ink in the discharge ports, the pressure displacing the ink and causing the ink to be discharged from the discharge ports.

11. An ink jet recording apparatus according to claim 7, wherein the discharge means generates heat energy to effect a change of state of ink in the discharge ports, the change of state creating a bubble and causing the ink to be displaced and discharged from the discharge ports.

12. An ink jet recording apparatus according to claim 8, wherein only the second pulse is applied when recording is not to be effected.

13. An ink jet recording apparatus according to claim 8, wherein only the second pulse is applied to the discharge means corresponding to the discharge ports which are not intended to discharge among the plurality of discharge ports.

14. An ink jet recording apparatus according to claim 8, wherein said pulse control means varies a waveform of the second pulse.

15. An ink jet recording apparatus according to claim 14, wherein said pulse control means varies a pulse width of the second pulse.

16. An ink jet recording apparatus according to claim 14, wherein said pulse control means varies a voltage value of the second pulse.

17. An ink jet recording apparatus for recording with an ink jet recording head having a plurality of discharge ports for discharging ink and discharge means provided corresponding to each of the discharge ports to cause the ink to discharge through a corresponding discharge port in response to application of drive signals, said apparatus effecting recording by discharging the ink onto a recording medium from the ink jet recording head, said apparatus comprising:

pulse control means for controlling a driving signal to be applied to the discharge means and changing an amount of an ink droplet discharged from the discharge port corresponding to the discharge means, the driving signal comprising a first pulse for discharging ink and a second pulse having an energy smaller than that of the first pulse and being applied to the discharge means prior to the first pulse, said pulse control means for individually changing the amount of the ink droplet discharged from each of the plurality of discharge ports; and discharge amount control means for changing at random a driving signal applied to each of the plurality of discharge means by said pulse control means in accordance with image data to be recorded and driving the plurality of discharge means, said discharge amount control means controlling so as to change at random the amount of the ink droplet discharged from each of the plurality of discharge ports, wherein said discharge amount control means differentiates an amount of variation in the discharge amount in accordance with a frequency of discharge represented by the image data.

18. An ink jet recording apparatus according to claim 17, wherein said pulse control means varies a voltage value of the second pulse.

19. An ink jet recording apparatus according to claim 17, wherein only the second pulse is applied when recording is not to be effected.

20. An ink jet recording apparatus according to claim 17, wherein only the second pulse is applied to the discharge means corresponding to the discharge ports which are not intended to discharge among the plurality of discharge ports.

21. An ink jet recording apparatus according to claim 17, wherein said discharge amount control means makes the amount of variation in the discharge amount greater as the frequency of discharge represented by the image data becomes higher.

22. An ink jet recording apparatus according to claim 17, wherein said discharge amount control means differentiates at random the discharge amount in only a case the frequency of discharge represented by the image data is high.

23. An ink jet recording apparatus according to claim 17, wherein said pulse control means varies a pulse width of the second pulse.

24. An ink jet recording method, for use with an ink jet recording head having a plurality of discharge ports for discharging ink and discharge means provided corresponding to each of the discharge ports to cause the ink to discharge through a corresponding discharge port in response to application of drive pulses, said method effecting recording by discharging the ink onto a recording medium from the ink jet recording head, said method comprising the steps of:

determining whether or not ink is discharged from each of the plurality of discharge means in accordance with image data to be recorded; and controlling to drive the discharge means by changing at random the driving pulse to be applied to the discharge means for discharging ink among the plurality of discharge means and to change an amount of an ink droplet discharged from the plurality of discharge ports, wherein the driving pulse is controlled so that an amount of variation in the discharge amount is differentiated in accordance with a frequency of discharge represented by the image data.

25. In ink jet recording method according to claim 24, wherein said control step controls the driving pulse so that an amount of variation in the discharge amount is made greater as the frequency of discharge represented by the image data becomes higher.

26. An ink jet recording method according to claim 24, wherein said controlling step controls the driving pulse to differentiate at random an amount of variation in the discharge amount only in a case that the frequency of discharge represented by the image data is high.

27. An ink jet recording method according to claim 24, wherein a standard deviation of volume distribution of the ink droplets which is varied at random is 9.0% or more.

28. An ink jet recording method according to claim 24, wherein the ink droplets are discharged onto a transfer sheet of which a load of a surface sizing agent is within a range of 0.8 to 3.9 weight % of the transfer sheet.

29. An ink jet recording method according to claim 24, wherein the ink contains 0.1 to 10 weight % of alkyl alcohol of one to four carbon numbers, or its halogen derivative, and viscosity of the ink is 2.0 cP or more at 25° C.

30. An ink jet recording method according to claim 29, wherein the ink further contains 0.1 to 10 weight % of hydrogen content heterocyclic compound and/or thiodiglycol.

31. An ink jet recording method according to claim 24, wherein the ink contains at least six to 50 weight % of oxyethylene addition polymer and/or triol, and 0.001 to 2 weight % of an interfacial activator.

32. An ink jet recording method according to claim 31, wherein the ink further contains 0.1 to 15 weight % of alkyl alcohol of one to four carbon numbers or its halogen derivative.

33. An ink jet recording method according to claim 24, wherein the ink contains at least six to 50 weight % of oxyethylene addition polymer and/or triol, 0.001 to 2 weight % of an interfacial activator, and 0.1 to 15 weight % of alkyl alcohol of one to four carbon numbers or its halogen derivative.

34. An ink jet recording method according to claim 33, wherein the alkyl alcohol is an alkyl alcohol of carbon number one, and the content of the alkyl alcohol or its halogen derivative is 0.1 to 15 weight %.

35. An ink jet recording method according to claim 33, wherein a standard deviation of volume distribution of the ink droplets which is varied at random is 9.0% or more.

36. An ink jet recording method according to claim 33, wherein the alkyl alcohol is an alkyl alcohol of carbon number two, and the content of the alkyl alcohol or its halogen derivative is 0.1 to 10 weight %.

37. An ink jet recording method according to claim 26, wherein the alkyl alcohol is an alkyl alcohol of carbon number three, and the content of the alkyl alcohol or its halogen derivative is 0.1 to 5 weight %.

38. An ink jet recording method according to claim 33, wherein the alkyl alcohol is an alkyl alcohol of carbon number four, and the content of the alkyl alcohol or its halogen derivative is 0.1 to 3 weight %.

39. An ink jet recording method, for use with an ink jet recording head having a plurality of discharge ports for discharging ink and discharge means provided corresponding to each of the discharge ports to cause ink to discharge through a corresponding discharge port in response to application of drive pulses, said method effecting recording by discharging the ink onto a recording medium from the ink jet recording head, said method comprising the steps of:

providing the ink containing at least 4 to 50 weight % of oxyethylene addition polymer and/or triol, with viscosity of the ink being 3.0 cP or less at 25° C. and surface tension of the ink being 55 dyne/cm or more;

determining whether or not the ink is discharged from each of the plurality of discharge ports in accordance with image data to be recorded; and controlling to drive the discharge means by changing at random the driving pulse to be applied to the discharge means for discharging ink among the plurality of discharge means and to change an amount of an ink droplet discharged from the plurality of discharge ports, wherein the driving pulse is controlled so that an amount of variation in the discharge amount is differentiated in accordance with a frequency of discharge represented by the image data.

40. In ink jet recording method according to claim 39, wherein said control step controls the driving pulse so that the amount of variation in the discharge amount is made greater as the frequency of discharge represented by the image data becomes higher.

41. An ink jet recording method according to claim 39, wherein said controlling step controls the driving pulse to differentiate at random the amount of variation in the discharge amount only in a case that the frequency of discharge represented by the image data is high.

42. An ink jet recording method according to claim 39, further comprising the steps of:

generating a change of state of the ink by heat in response to applied electrical energy, the change of state causing the ink to be discharged from the discharging ports, and controlling discharge of the ink by varying the applied electrical energy at random, such that a volume of ink discharged from the plurality of discharging ports is varied at random per discharge.

43. An ink jet recording method according to claim 39, further comprising the step of discharging the ink from the plurality of discharge ports such that volumes of discharged ink vary, wherein a standard deviation of volume distribution of ink droplet diameter which is varied at random is 9.0% or more.

44. An ink jet recording method according to claim 39, further comprising the step of discharging the ink onto a transfer sheet for which the load of a surface sizing agent is 0.8 to 3.9 weight % of the transfer sheet.

45. An ink jet recording method according to claim 44, wherein the transfer sheet utilized in said discharging step comprises a surface sizing agent in a load ratio such that the transfer sheet can be used in an electronic photographing method.

46. An ink jet recording method according to claim 39, wherein said providing step provides the ink containing at least four to 50 weight % of oxyethylene addition polymer and/or triol, and 0.1 to 10 weight % of alkyl alcohol of one to four carbon numbers, or its halogen derivative, and the viscosity of the ink is 2.0 cP or more at 25° C.

47. An ink jet recording method according to claim 46, wherein the ink further contains 0.1 to 10 weight % of hydrogen content heterocyclic compound and/or thiodiglycol.

48. An ink jet recording method according to claim 39, wherein said providing step provides the ink containing at least six to 50 weight % of oxyethylene addition polymer and/or triol, and 0.001 to 2 weight % of an interfacial activator.

49. An ink jet recording method according to claim 48, wherein the ink further contain 0.1 to 15 weight % of alkyl alcohol of one to four carbon numbers or its halogen derivative.

50. An ink jet recording method according to claim 49, wherein the alkyl alcohol is an alkyl alcohol of carbon number one, and the content of the alkyl alcohol or its halogen derivative is 0.1 to 15 weight %.

51. An ink jet recording method according to claim 49, wherein the alkyl alcohol is an alkyl alcohol of carbon number two, and the content of the alkyl alcohol or its halogen derivative is 0.1 to 10 weight %.

52. An ink jet recording method according to claim 49, wherein the alkyl alcohol is an alkyl alcohol of carbon number three, and the content of the alkyl alcohol or its halogen derivative is 0.1 to 5 weight %.

53. An ink jet recording method according to claim 49, wherein the alkyl alcohol is an alkyl alcohol of carbon number four, and the content of the alkyl alcohol or its halogen derivative is 0.1 to 3 weight %.

* * * * *

UNITED STATES PATENT AND TRADEMARK OFFICE

CERTIFICATE OF CORRECTION

PATENT NO. : 5,997,122

DATED : December 7, 1999

INVENTOR(S) : MORIYAMA ET AL.

It is certified that error appears in the above-identified patent and that said Letters Patent is hereby corrected as shown below:

COLUMN 2:
Line 3, "with a" should read --with--.

COLUMN 4:
Line 24, "but," should be deleted.
Line 67, "forgoing" should read --foregoing--.

COLUMN 5:
Line 6, "forgoing" should read --foregoing--.
Line 31, "width a" should read --width σ--.
Line 39, "becomes" should read --become-- and "defect" should read --defects--.
Line 44, "exceed" should read --exceeds--.

COLUMN 8:
Line 37, "of the each" should read --of each--.

COLUMN 9:
Line 25, "an attention" should read --attention--.

COLUMN 11:
Line 44, "respectively." should read --respectively, are formed.--.

COLUMN 12:
Line 66, "If" should read --With--.

UNITED STATES PATENT AND TRADEMARK OFFICE

CERTIFICATE OF CORRECTION

PATENT NO. : 5,997,122

DATED : December 7, 1999

INVENTOR(S) : MORIYAMA ET AL.

It is certified that error appears in the above-identified patent and that said Letters Patent is hereby corrected as shown below:

COLUMN 13:
Line 5, "every" should be deleted.
Line 11, "dimethylhormamide," should read --dimethylformamide,--.
Line 18, "buthylene" should read --butylene--.

COLUMN 14:
Line 2, "every" should be deleted.
Line 6, "group" should read --groups are--.
Line 19, "a occupying" should read --an occupying--.
Line 24, "when" should read --for--.
Line 32, "when" should read --for--.
Line 45, "when" should read --for--.
Line 46, "the" (first occurrence) should be deleted, and "the" (second occurrence) should read --The--.
Line 65, "shots" should read --is ejected onto--.

COLUMN 16:
Line 7, "ink" should read --inks--.
Line 60, "further. Varying" should read --further varying--.

COLUMN 18:
Line 62, "electronic photographing." should read --electrophotographic recording method.--.

UNITED STATES PATENT AND TRADEMARK OFFICE

CERTIFICATE OF CORRECTION

PATENT NO. : 5,997,122

DATED : December 7, 1999

INVENTOR(S) : MORIYAMA ET AL.

It is certified that error appears in the above-identified patent and that said Letters Patent is hereby corrected as shown below:

COLUMN 19:
Line 2, "well" should read --were--.
Line 5, "the," should read --the--.
Line 8, "the Table" should read --Table--.

COLUMN 21:
Line 8, "the" (second occurrence) should be deleted.
Line 62, "parcentage" should read --percentage--.

COLUMN 23:
Line 1, "claim 7," should read --claim 8,--.

COLUMN 24:
Line 27, "In" should read --An--.

COLUMN 25:
Line 12, "claim 26," should read --claim 33,--.
Line 44, "In" should read --An--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*